US011994359B2

(12) United States Patent
Springer

(10) Patent No.: US 11,994,359 B2
(45) Date of Patent: May 28, 2024

(54) ARCHERY HOOK ENGAGER AND METHOD FOR ARCHERY RELEASE DEVICES

(71) Applicant: Copper John Corporation, Auburn, NY (US)

(72) Inventor: Eric C. Springer, Moravia, NY (US)

(73) Assignee: Copper John Corporation, Auburn, NY (US)

( * ) Notice: Subject to any disclaimer, the term of this patent is extended or adjusted under 35 U.S.C. 154(b) by 0 days.

(21) Appl. No.: 18/093,928

(22) Filed: Jan. 6, 2023

(65) Prior Publication Data

US 2023/0213302 A1 Jul. 6, 2023

Related U.S. Application Data

(60) Provisional application No. 63/297,204, filed on Jan. 6, 2022.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 6,571,786 | B2 * | 6/2003 | Summers | F41B 5/1469 124/35.2 |
| 6,945,241 | B2 * | 9/2005 | Pellerite | F41G 1/35 124/35.2 |
| 6,953,035 | B1 * | 10/2005 | Summers | F41B 5/1469 124/35.2 |
| 9,625,230 | B2 | 4/2017 | Kelly et al. | |
| 9,702,658 | B2 | 7/2017 | Horn | |
| 10,145,646 | B2 | 12/2018 | Kelly | |
| 10,436,544 | B1 | 10/2019 | Jones | |
| 10,731,943 | B2 | 8/2020 | Horn et al. | |
| 10,830,554 | B1 * | 11/2020 | Jones | F41B 5/1469 |
| 11,067,356 | B2 * | 7/2021 | Haas | F41B 5/1469 |
| 11,353,281 | B1 * | 6/2022 | Rentz | F41B 5/1469 |
| 2011/0168146 | A1 | 7/2011 | Deceuster | |
| 2012/0192844 | A1 * | 8/2012 | Springer | F41B 5/1469 124/35.2 |

* cited by examiner

*Primary Examiner* — John A Ricci
(74) *Attorney, Agent, or Firm* — Barclay Damon LLP

(57) ABSTRACT

An archery hook engager includes, in an embodiment, a first portion defining a first opening configured to receive a pivot member of an archery release device. The archery release device has a body, a carriage, and a hook pivotally coupled to the carriage. The pivot member is coupled to the carriage. The archery hook engager also includes a second portion configured to define a second opening that has an opening dimension. The second opening is configured to receive a stopper that is coupled to the body. The stopper includes a stopper dimension. There is difference between the opening dimension and the stopper dimension that results in a gap between the second portion and the stopper. Furthermore, the archery hook engager includes a hook interface portion configured to be engaged with a hook engagement portion of the hook.

21 Claims, 26 Drawing Sheets

(PRIOR ART: U.S. PATENT NO. 10,436,544)

(PRIOR ART: U.S. PATENT NO. 10,436,544)

(PRIOR ART: U.S. PATENT NO. 10,436,544)

ARCHERY HOOK ENGAGER AND METHOD FOR ARCHERY RELEASE DEVICES

CROSS-REFERENCE TO RELATED APPLICATION

This application is a non-provisional of, and claims the benefit and priority of, U.S. Provisional Patent Application No. 63/297,204 filed on Jan. 6, 2022. The entire contents of such application are incorporated herein by reference.

BACKGROUND

Archers use archery release aids to hold a bowstring in the drawn position. The known release aids attach to the bowstring and enable the user archer to pull the bowstring to the drawn position. The user activates the release aid, either by activating a trigger or by jerking the release, to cause the bowstring to slide off of the release aid's hook, thereby enabling the bowstring to propel an arrow toward a target.

There are known release aids, sometimes referred to as hinged release devices, that include a release case and a head carrying both a hook and a sear. The sear interacts with the hook to control the firing position of the hook. The known hinged release device has a fastener that enables the user to adjust and then fix the position of the sear relative to the head. When the user jerks the release to fire, the sear remains stationary, and the hook must free itself from the sear in order for the hook to release the bowstring.

An example of a known hinged release device is disclosed in U.S. Pat. No. 10,436,544, as shown in FIGS. 1-3. This prior art archery release 10 includes a release body 20 joined to a release head 30, which includes a hook sear 50 and a pawl 60. The pawl 60 is located next to the hook sear 50. The prior art archery release 10 also has fasteners 65, 68. In the user's setup process, before the firing operation begins, the user adjusts the position of the pawl 60 relative to the hook sear 50, and then the user locks the pawl 60 in place relative to the body 20. To do so, the user screws the fasteners 65, 68 in order to apply a locking force to the pawl 60. Once the firing operation begins, and throughout the firing operation, the pawl 60 remains fixed in position relative to the body 20.

This prior art design and assembly has disadvantages regarding the rate of action and sensitivity of the release. Also, this prior art design and assembly involves an undesirable level of frictional force and interference force between the pawl 60 and the hook sear 50, resulting in an undesirable level of frictional, vibrational or force feedback for users. Furthermore, this prior art design and assembly lacks, among other features, micro adjustability for the release point of the hook and a safety mode.

The foregoing background describes some, but not necessarily all, of the problems, disadvantages and shortcomings related to the known archery release aids.

SUMMARY

In an embodiment, the archery hook engager includes a bias interface portion configured to be engaged with a biasing member of an archery release device. The archery release device includes a body, a carriage, a pivot member coupled to the carriage, and a hook that is pivotally coupled to the carriage. The archery hook engager also includes a pivot portion that defines a pivot opening configured to receive the pivot member. Also, the archery hook engager includes a motion portion that defines a motion opening configured to receive a stopper that is coupled to the body.

The stopper includes a diameter. The motion opening is greater in dimension than the diameter so as to define a gap between the motion portion and the stopper. Furthermore, the archery hook engager includes a hook interface portion configured to be engaged with a hook engagement portion of the hook. When the hook is engaged with a bowstring and the archery release device is jerked away from the bowstring, the motion portion is configured to move relative to the stopper to facilitate disengaging the hook interface portion from the hook engagement portion.

In another embodiment, the archery hook engager includes a first portion defining a first opening configured to receive a pivot member of an archery release device. The archery release device includes a body, a carriage, and a hook pivotally coupled to the carriage. The pivot member is coupled to the carriage. The archery release device also includes a second portion configured to define a second opening that includes an opening dimension. The second opening is configured to receive a stopper that is coupled to the body. The stopper includes a stopper dimension. There is a difference between the opening dimension and the stopper dimension that results in a gap between the second portion and the stopper. Furthermore, the archery release device includes a hook interface portion configured to be engaged with a hook engagement portion of the hook.

In yet another embodiment, the method of manufacturing the archery hook engager includes structuring a first portion so as to define a first opening configured to receive a pivot member of an archery release device that includes a body, a carriage, and a hook pivotally coupled to the carriage, wherein the pivot member is coupled to the carriage. The method also includes structuring a second portion so as to define a second opening that includes an opening dimension, wherein the second opening is configured to receive a stopper that is coupled to the body, wherein the stopper includes a stopper dimension, wherein a difference between the opening dimension and the stopper dimension results in a gap between the second portion and the stopper. Furthermore, the method includes structuring a hook interface portion to be engaged with a hook engagement portion of the hook.

BRIEF DESCRIPTION OF THE DRAWINGS

So that the manner in which the features of the disclosure can be understood, a detailed description may be had by reference to certain embodiments, some of which are illustrated in the accompanying drawings. It is to be noted, however, that the drawings illustrate only certain embodiments and are therefore not to be considered limiting of its scope, for the scope of the disclosed subject matter encompasses other embodiments as well. The drawings are not necessarily to scale, emphasis generally being placed upon illustrating the features of certain embodiments. In the drawings, like numerals are used to indicate like parts throughout the various views, in which.

DESCRIPTION

Throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example.

Figure 1:
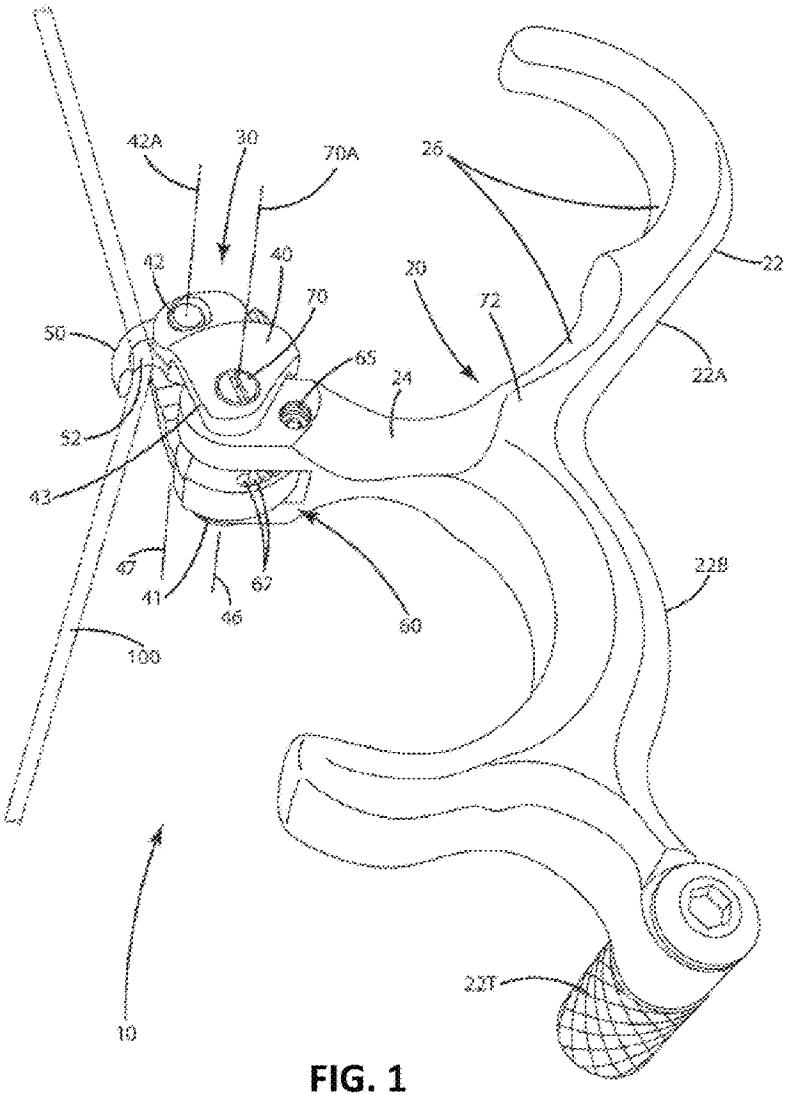
FIG. 1 is an isometric side view of a prior art archery release.
Figure 2:
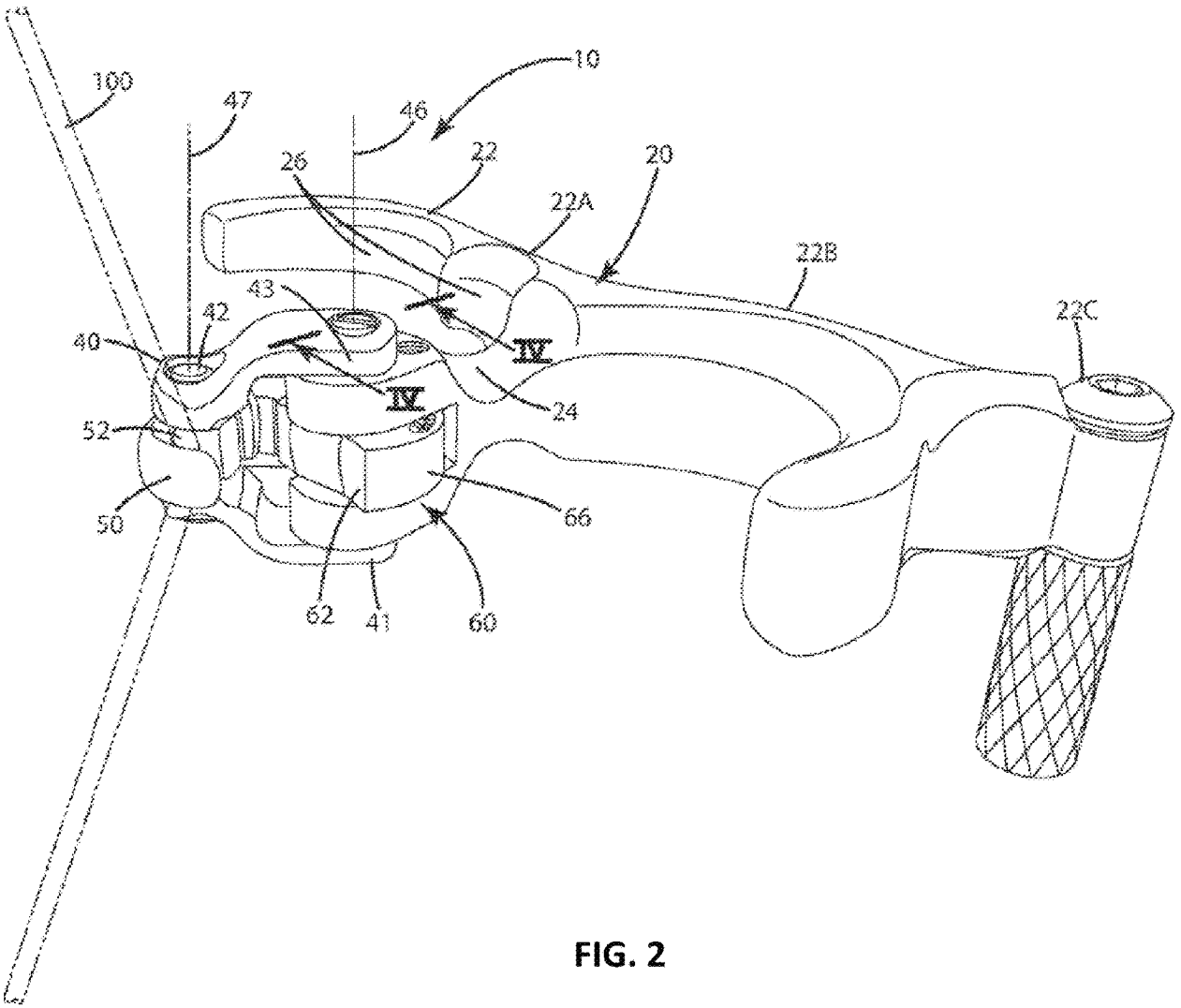
FIG. 2 is an isometric front view of the prior art archery release of FIG. 1.
Figure 3:
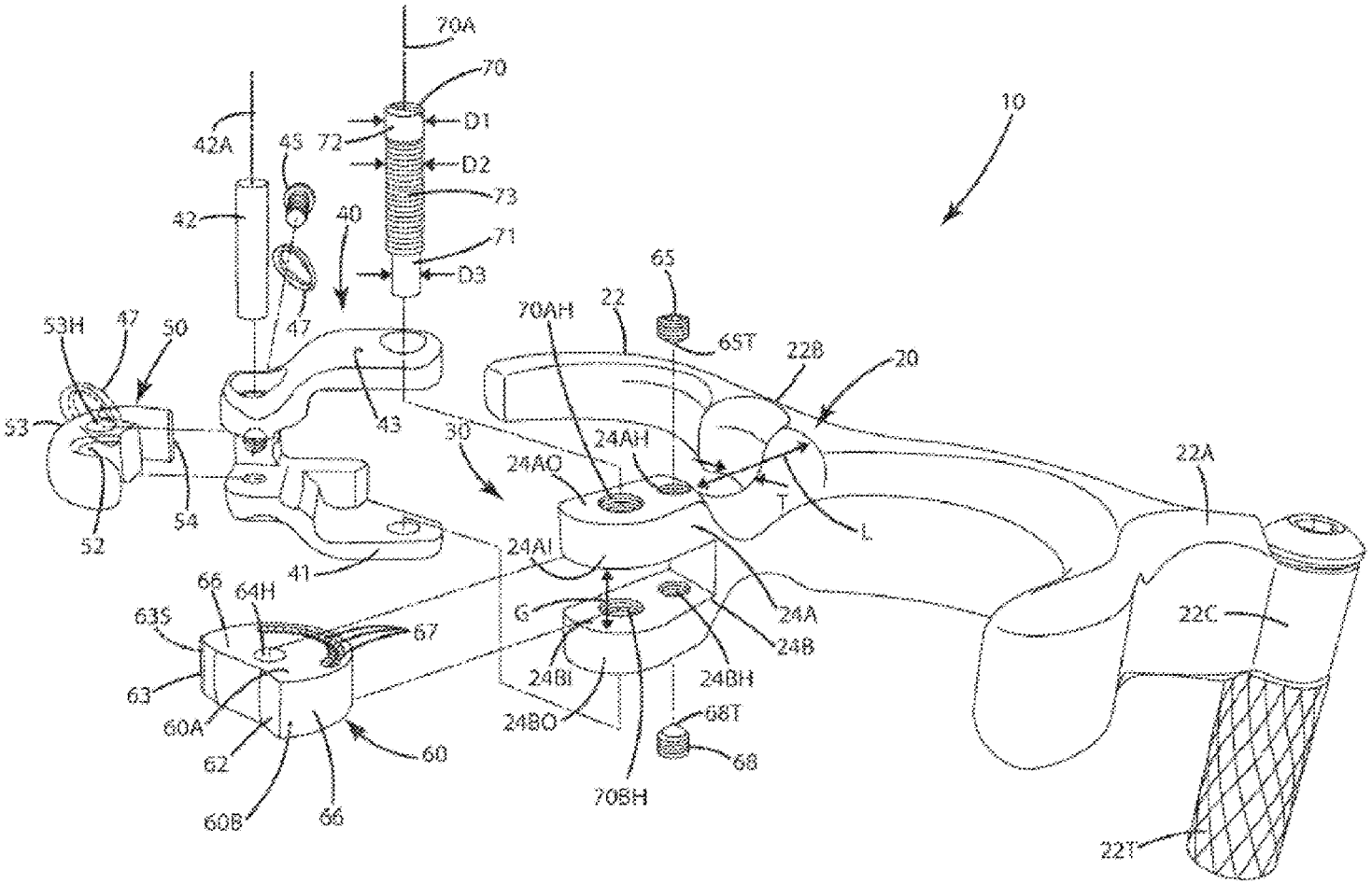
FIG. 3 is an exploded view of the prior art archery release of FIG. 1.
Figure 4:
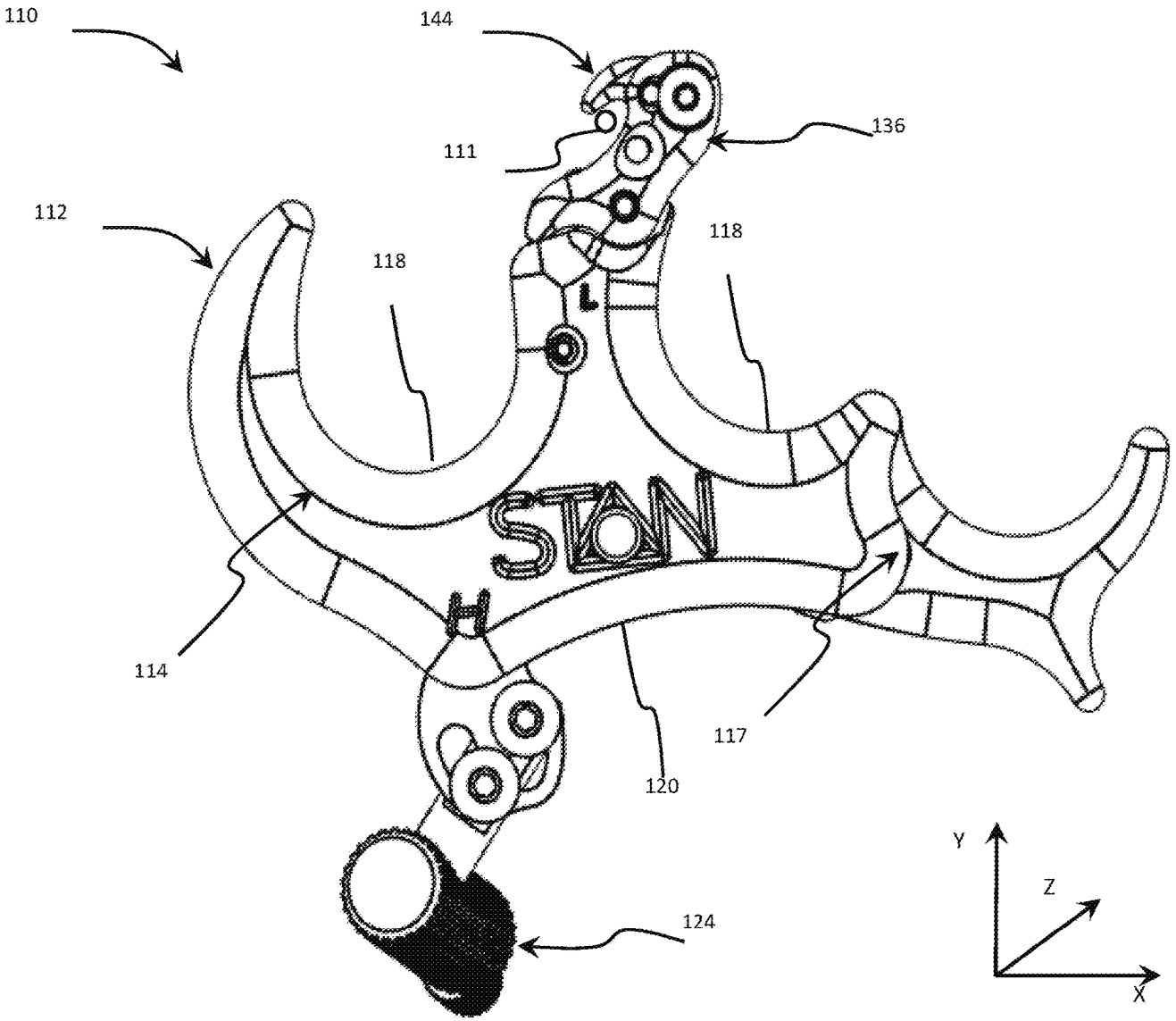
FIG. 4 is a first side view of an embodiment of an archery release device according to the following disclosure.
Figure 5:
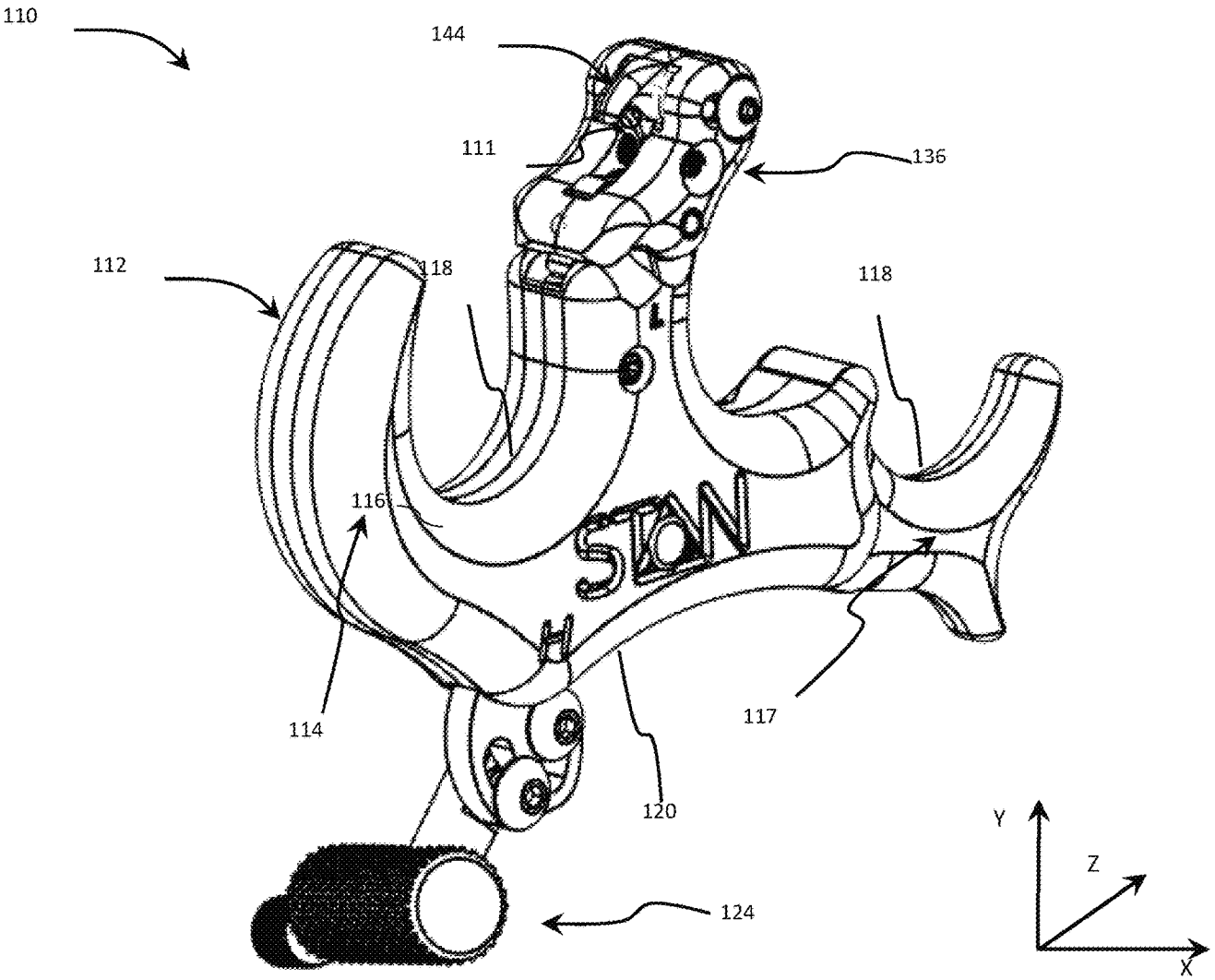
FIG. 5 is an isometric first side view of the embodiment of the archery release device of FIG. 4.
Figure 6:
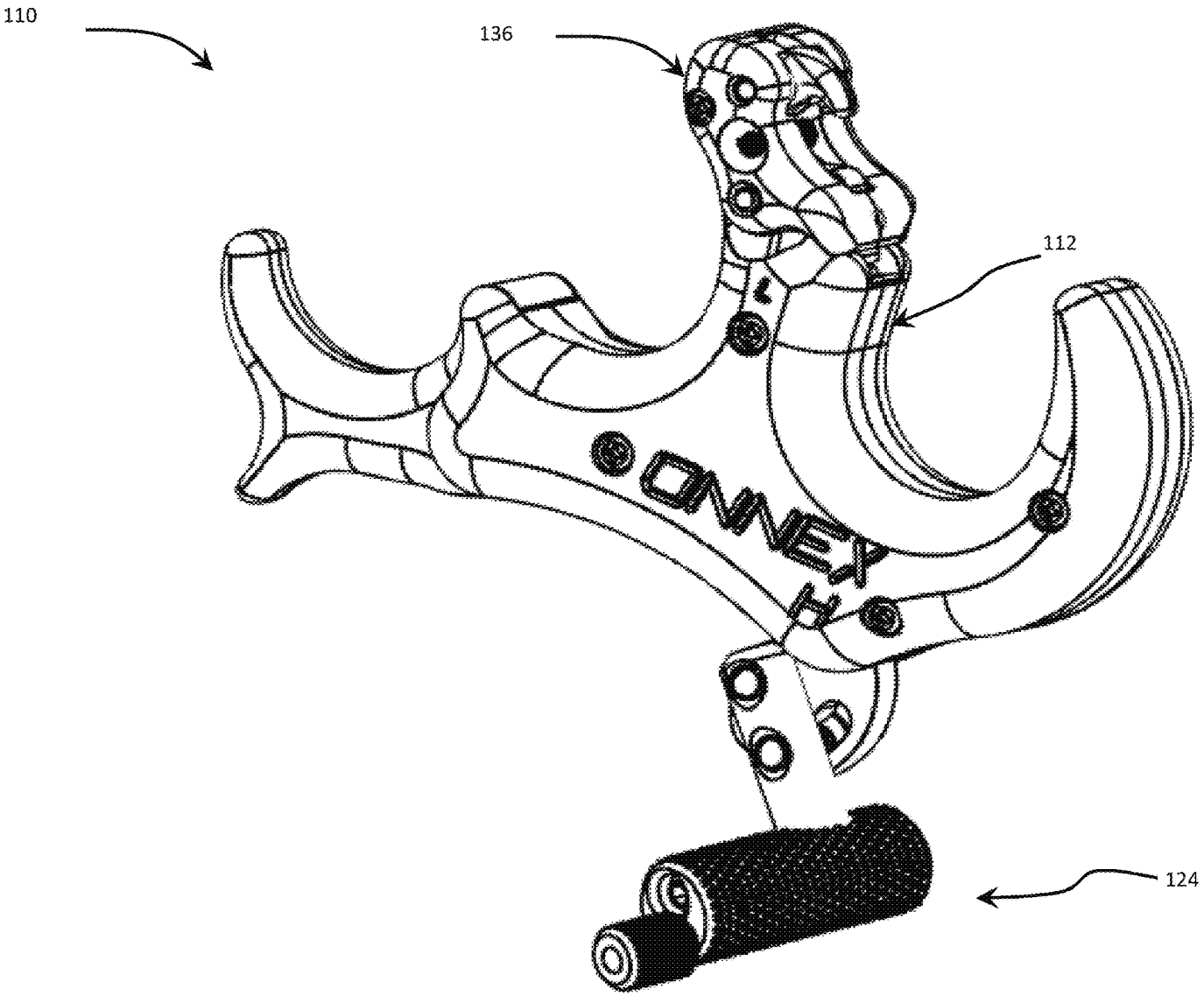
FIG. 6 is an isometric second side view of the embodiment of FIG. 4.

As illustrated in FIGS. 4-6, in an embodiment, an archery release device 110 is usable to retract and release a bowstring or draw cord 111 of an archery shooting device, such as an archery bow, including a compound bow, a recurve bow and a fishing bow. The archery release device 110 includes a case, housing or body 112 having a right side panel 114 and a left side panel 116 configured to be joined with the right side panel 114. The archery release device 110 also includes a grasp 117 having a plurality of finger interface surfaces that are spaced apart from each other and configured to engage a plurality of fingers of the user. When joined or fastened together, the right and left side panels 114, 116 in conjunction with the grasp 117 collectively define a front surface 118 and a rear surface 120. In use, the front surface 118 faces toward a target, and the rear surface 120 faces the user in a direction opposite of the target.

In an embodiment, the archery release device 110 is a triggerless release device, such as a back tension release or a hinge release. With prior art triggerless release aids, the user can accidentally cause the archery release aid to release the draw cord due to an unintentional or accidental body jerk. Therefore, the archery release device 110 includes a safety device or safety assembly 122, as described below.

Figure 7:
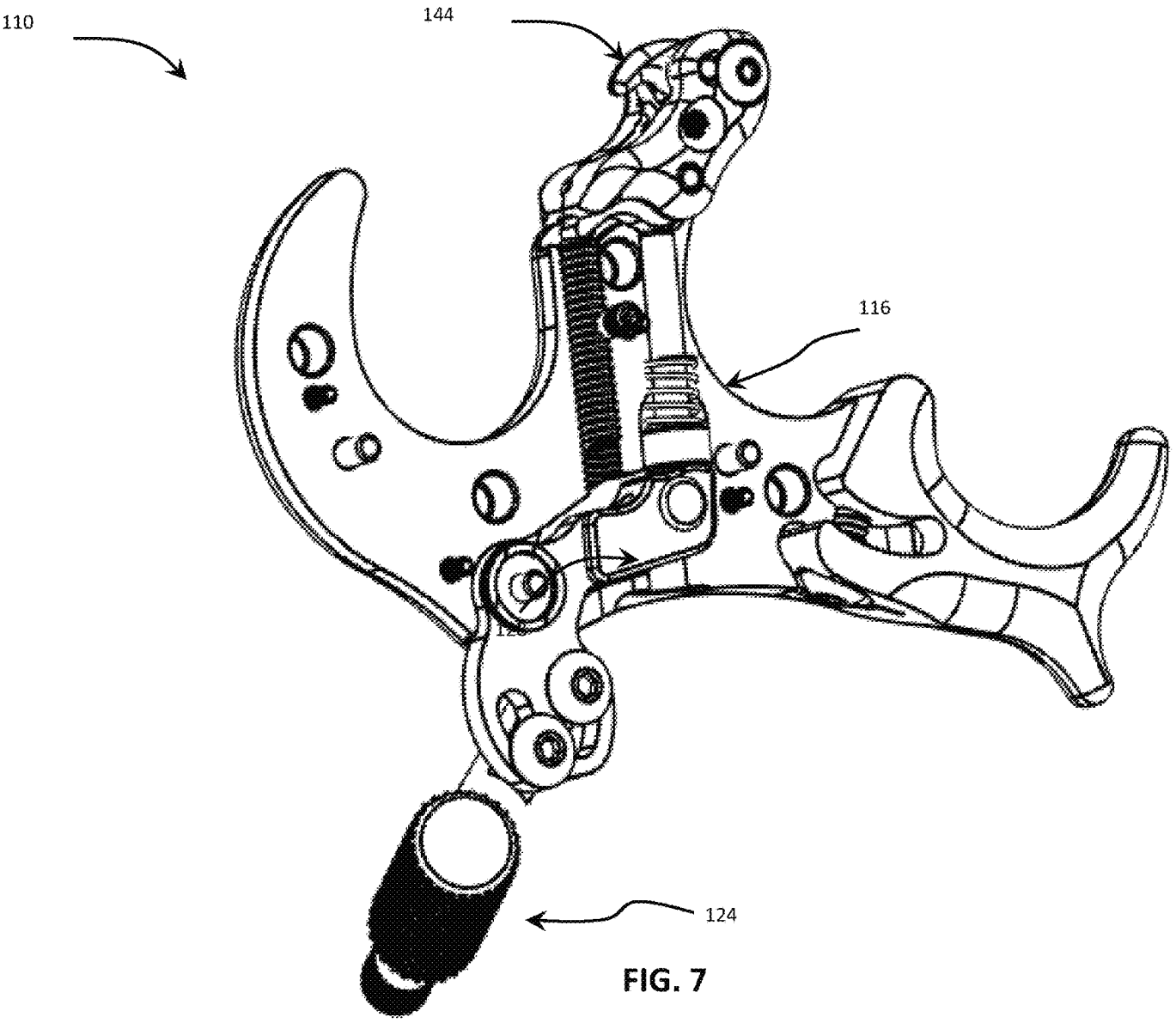
FIG. 7 is an isometric first side view of the embodiment of FIG. 4 with a right portion of the housing removed to show a portion of a safety assembly.
Figure 8:
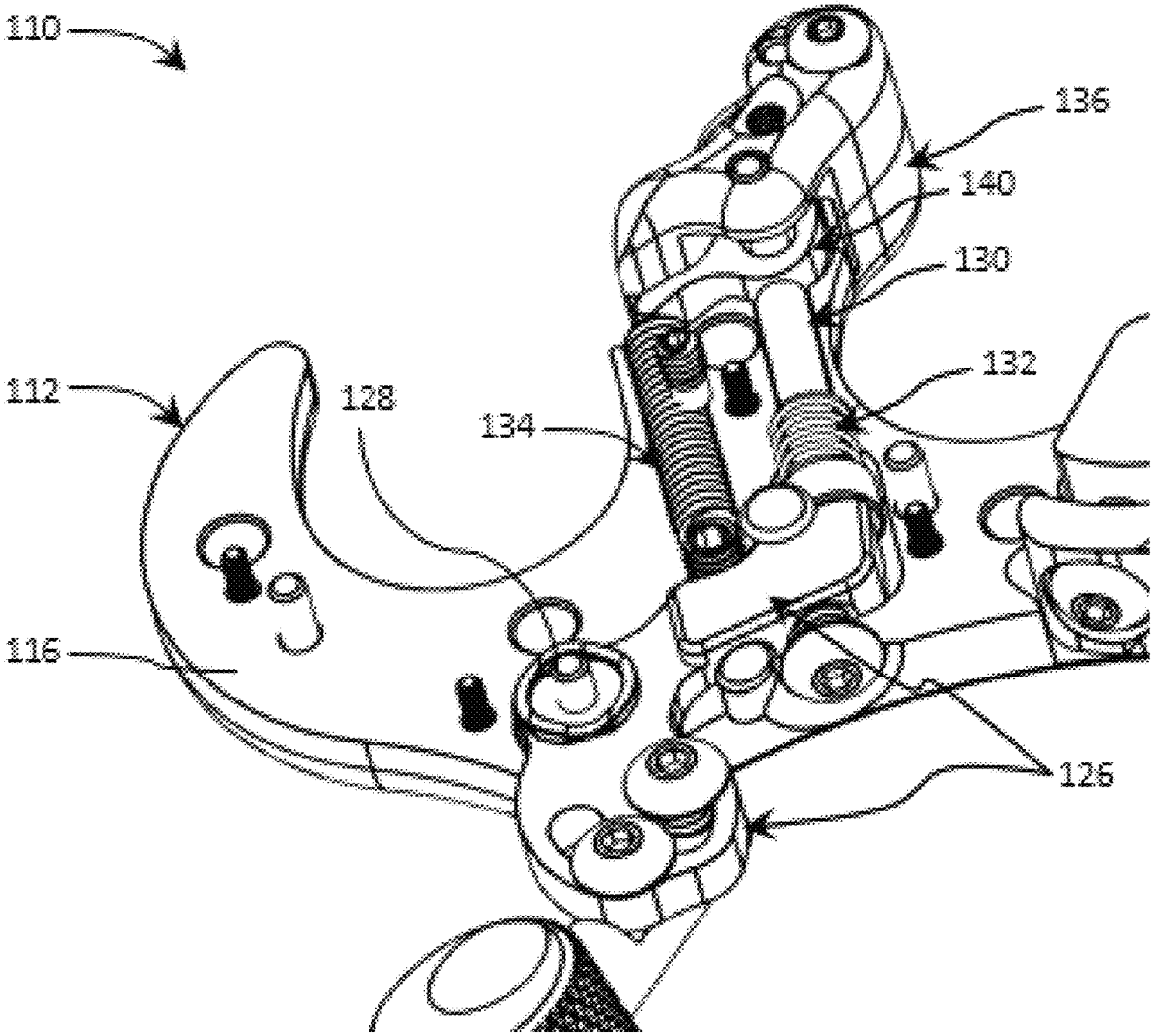
FIG. 8 is a close-up, enlarged view of a portion of the embodiment of FIG. 4.
Figure 9:
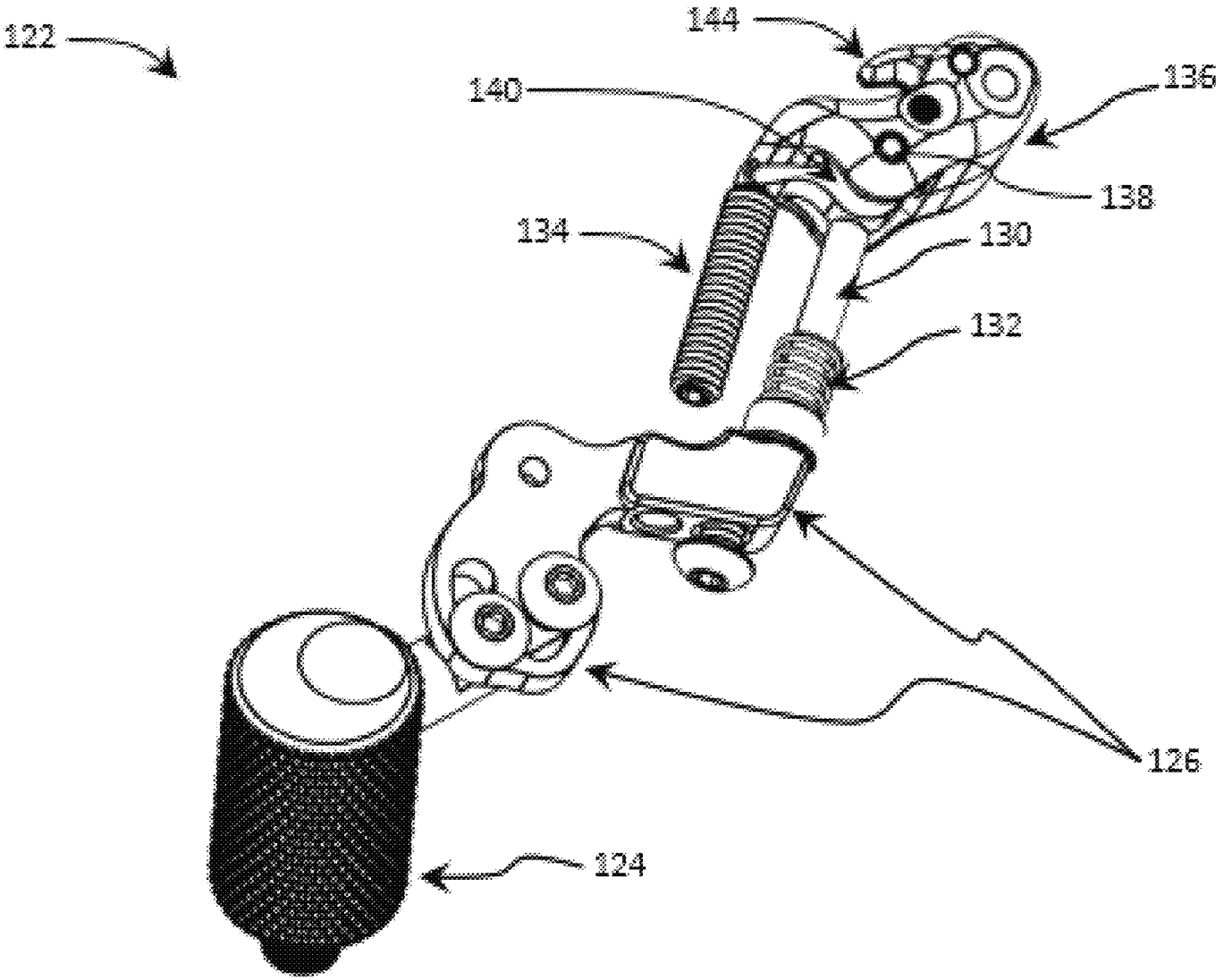
FIG. 9 is a side isometric view of an embodiment of a safety assembly from FIG. 4.

As shown in FIGS. 7-9, the archery release device 110 includes an assembly 122 coupled to the body 112. In the embodiment shown, the assembly 122 includes: (a) a thumb grasp 124 engagable by the user's thumb; (b) a safety element or safety link 126 connected to the thumb grasp 124, the safety link 126 being pivotable about a safety pivot member 128; (c) a safety push rod, pin or safety driver 130 supported by the body 112 and configured to translate in a fore-aft direction relative to the body 112 in response to a force applied by the safety link 126; (d) a safety spring or safety biasing member 132 that encircles and spring-activates the safety driver 130; (e) a set screw or release point setter 134 that threadably engages with the left side panel 116; (f) a head or carriage 136 pivotally coupled to the left side panel 116 through a body element 138; (g) a holder, retainer, pawl, moon or hook engager 140 pivotally coupled to the carriage 136 at a pivot portion 141 through a hook engager pivot member 142; and (h) a bowstring hook, hook, cord holder, or cord hook 144 pivotally coupled to the carriage 136 through a cord hook pivot member 146.

Referring to FIGS. 10-17C, the hook engager 140 includes: (a) a bias mount or bias interface portion 148 defining a cavity configured to receive a hook engager biasing member 150, a spring or other suitable biasing member (see, e.g., FIG. 19); (b) the pivot portion 141, which defines a pivot bore, pivot channel or pivot opening 151 configured to receive the hook engager pivot member 142, which, in turn, extends into the lower bores or channels 166, 168, defined by the right and left carriage halves 152, 154, respectively, of the carriage 136; (c) a motion portion 143 defining a pivot limiter bore, pivot limiter channel, motion channel or motion opening 156 configured to receive the body element 138; (d) an interference surface 158 configured and positioned to engage and interfere with the hook engagement surface 160 or hook engagement portion of the cord hook 144; (e) a safety engagement surface 162 configured and positioned to engage and interfere with the end of the safety driver 130; and (f) an adjustment engagement surface 164 configured and positioned to engage the end of the release point setter 134.

As illustrated, the hook engager 140 is pivotally coupled to the carriage 136 by virtue of the hook engager pivot member 142. In contrast, the carriage 136 is pivotally coupled to the body 112 by virtue of the body element 138. Accordingly, the hook engager 140 and carriage 136 pivot about independent axes relative to the body 112.

Figure 10:
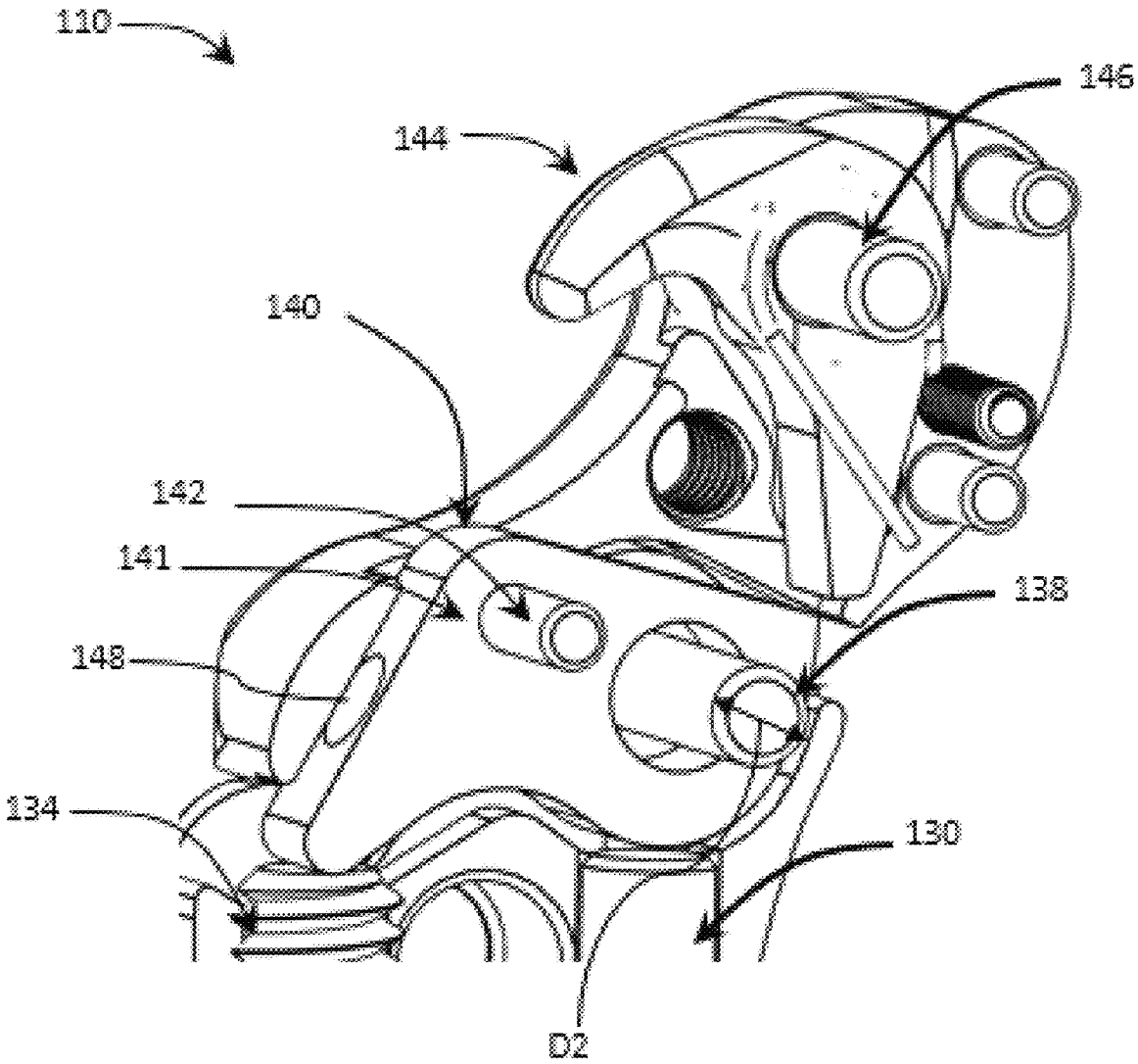
FIG. 10 is a close-up, enlarged view of an embodiment of a carriage of FIG. 4 with a right side of the carriage housing removed.
Figure 11:
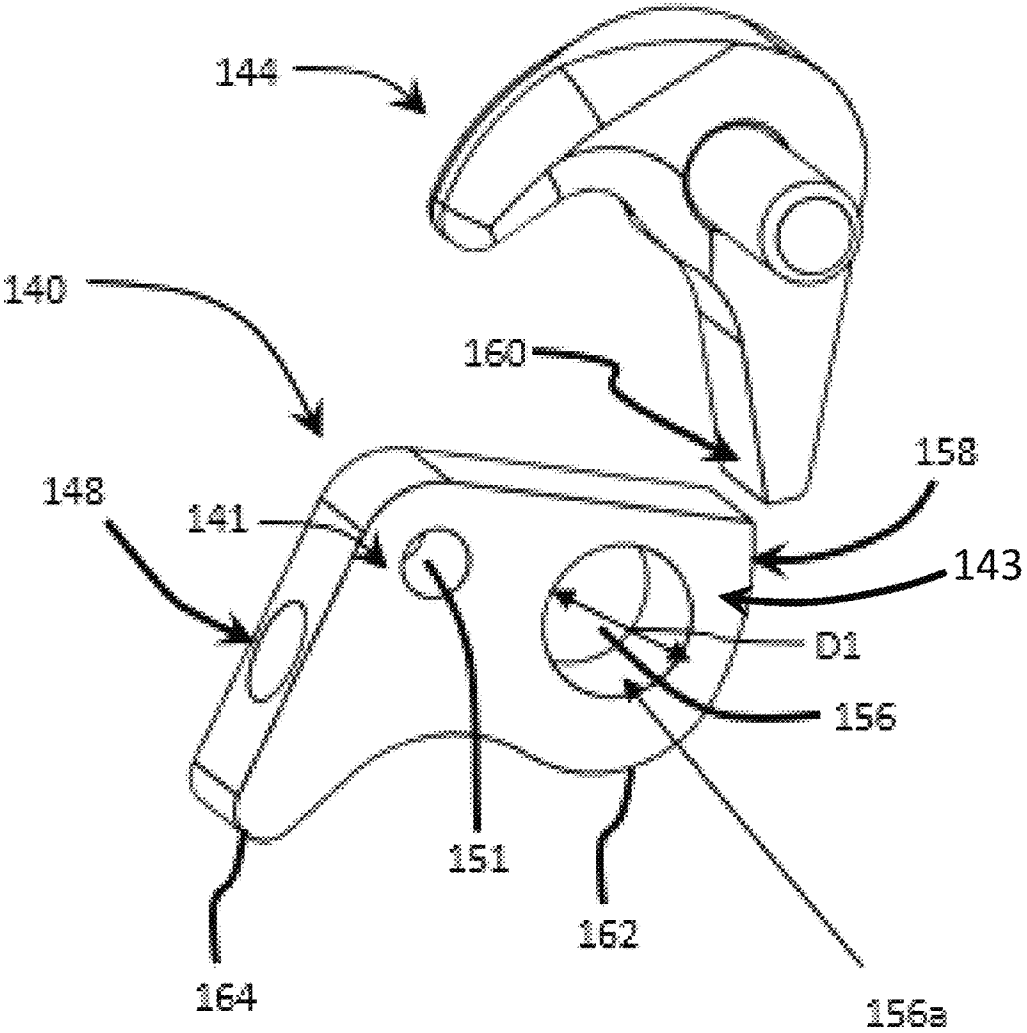
FIG. 11 is an isometric side view of an embodiment of a hook engager and cord hook removed from the embodiment of the carriage of FIG. 4.
Figure 12:
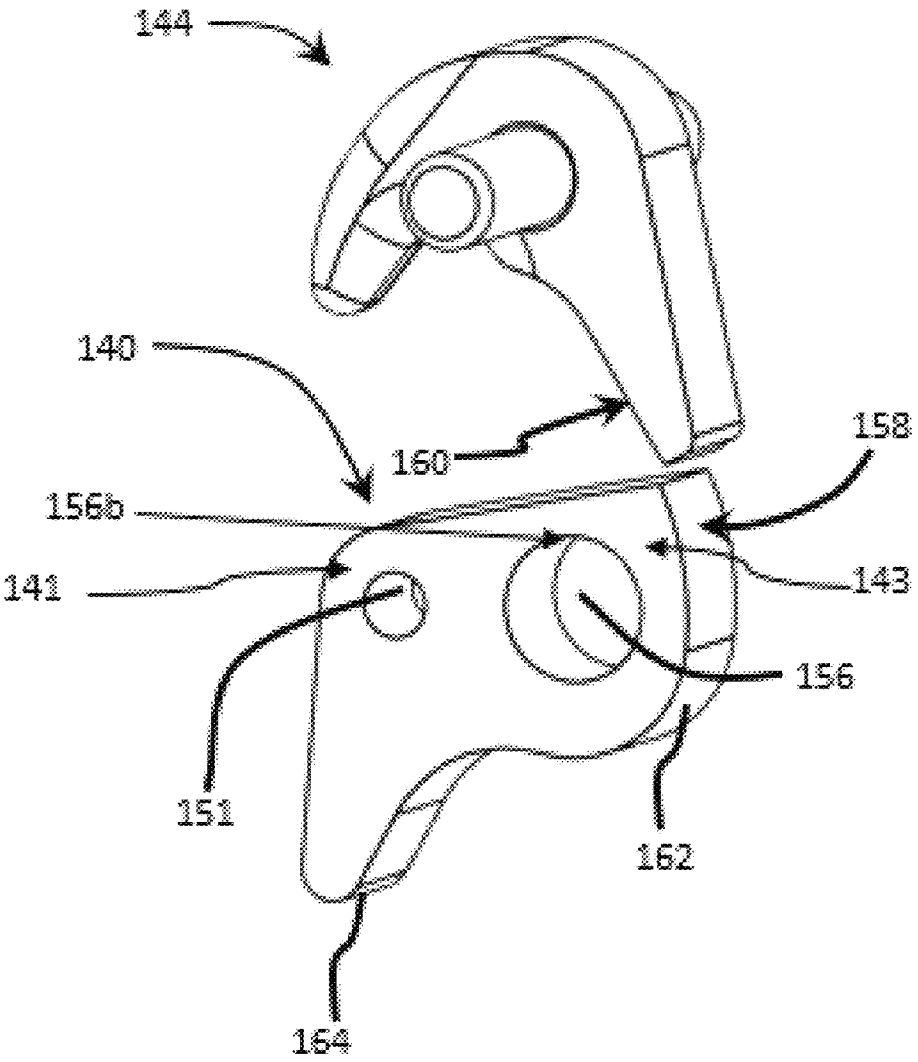
FIG. 12 is another isometric side view of the hook engager and cord hook of the embodiment of FIG. 4.
Figure 13:
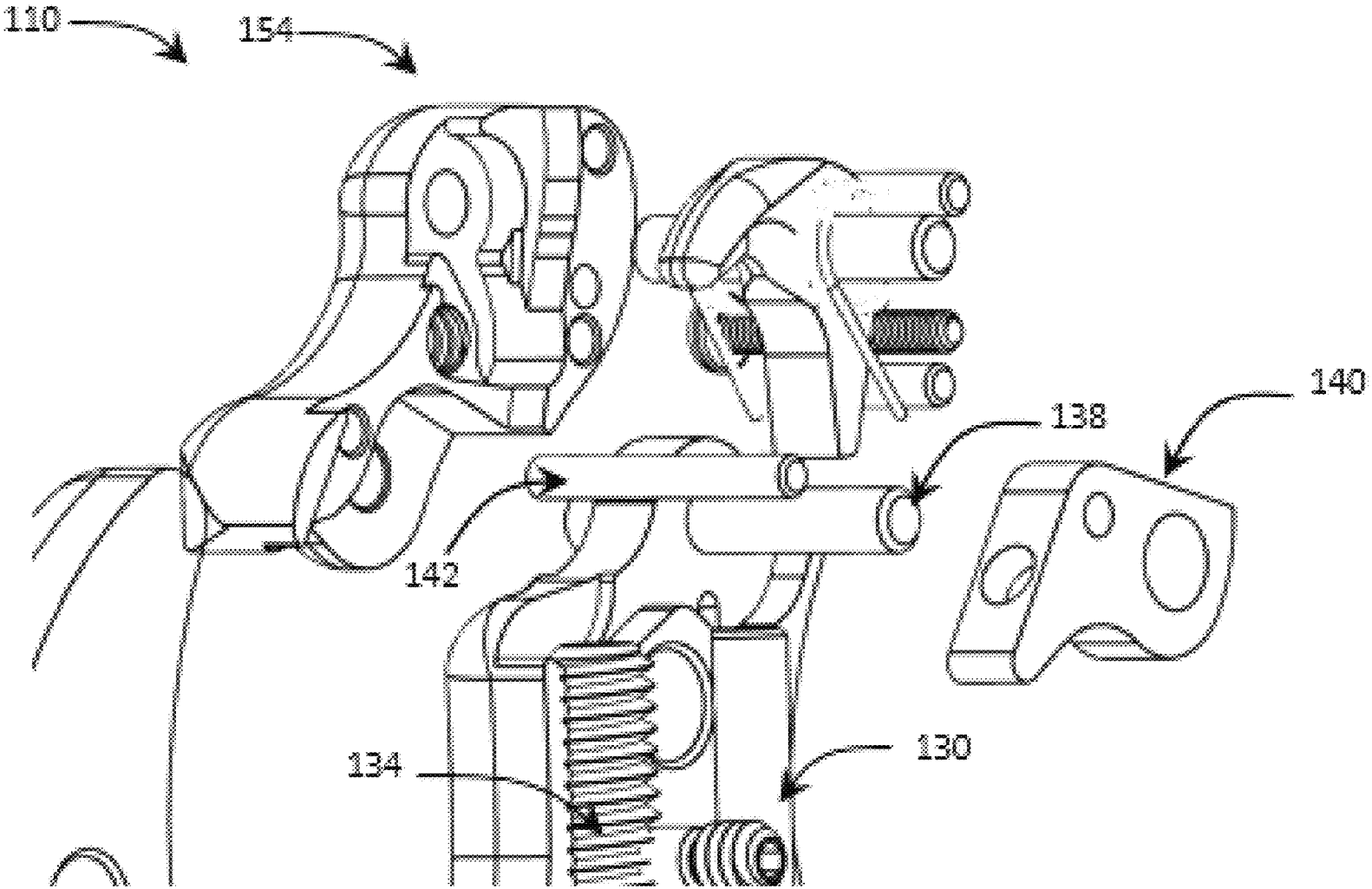
FIG. 13 is an exploded view of the embodiment of the carriage of FIG. 4.
Figure 14:
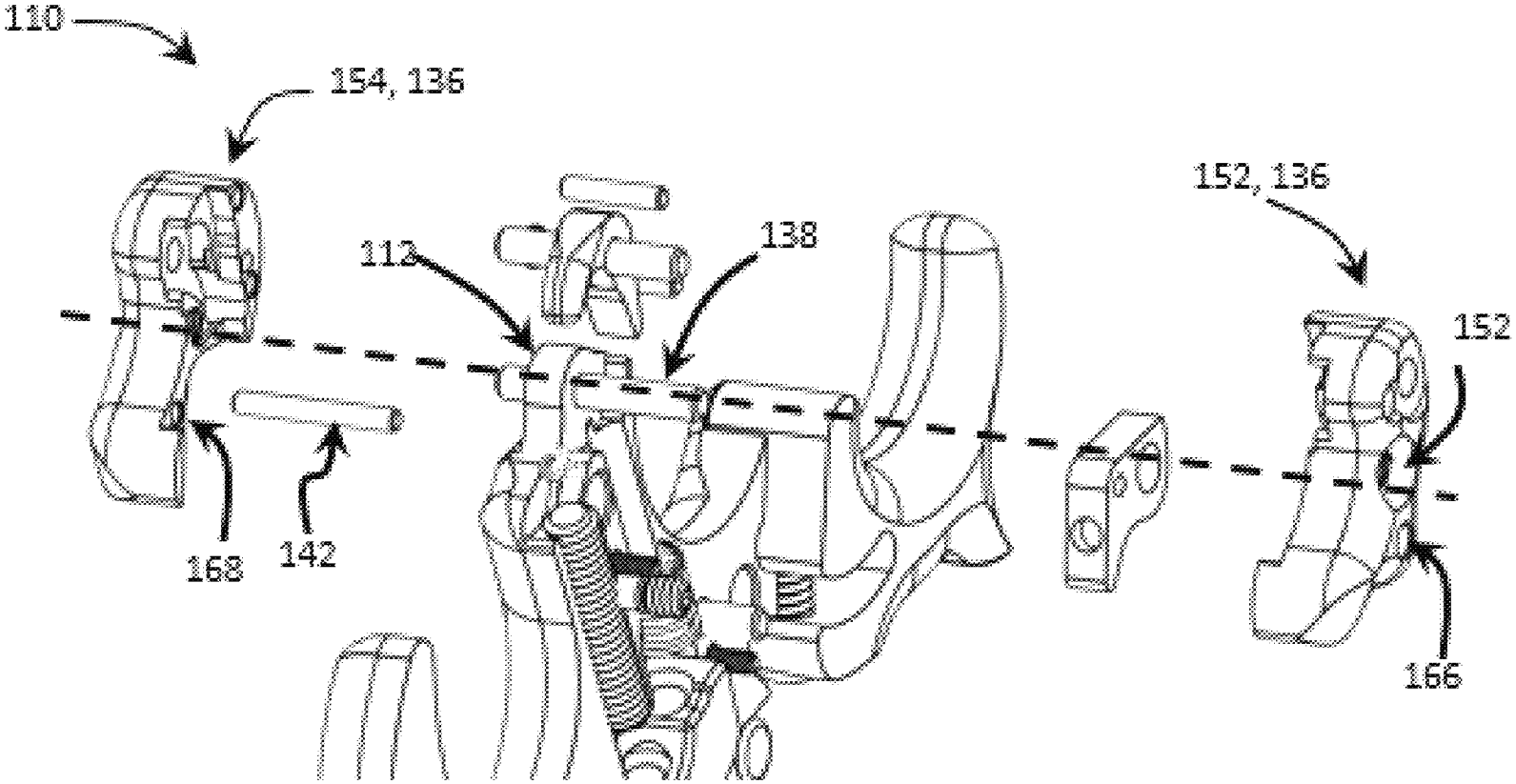
FIG. 14 is an exploded view of the carriage of the embodiment of FIG. 4, showing right and left sides of the carriage housing.
Figure 15:
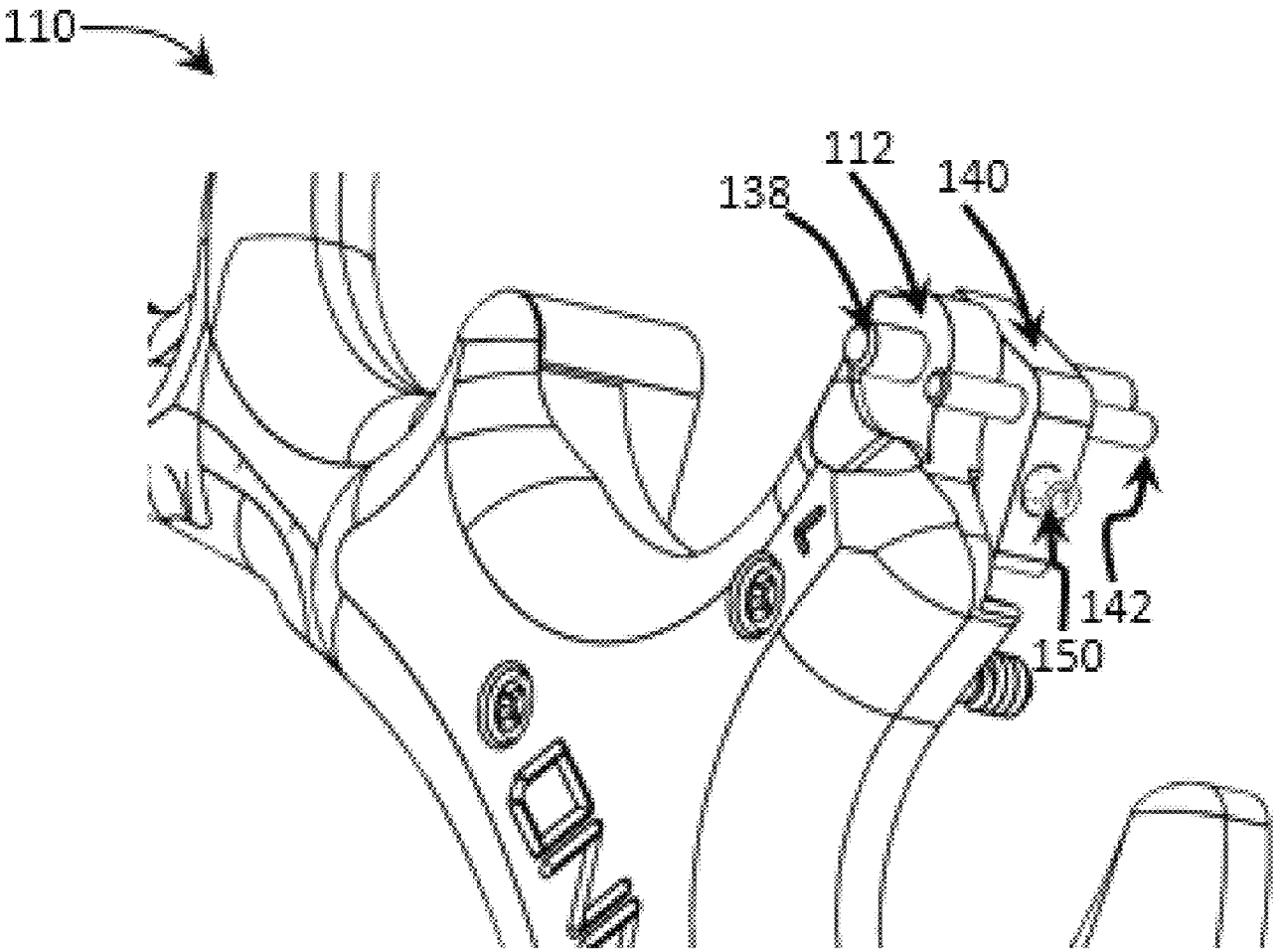
FIG. 15 is a close-up, enlarged view of the embodiment of FIG. 4, having the carriage housing removed.
Figure 20:
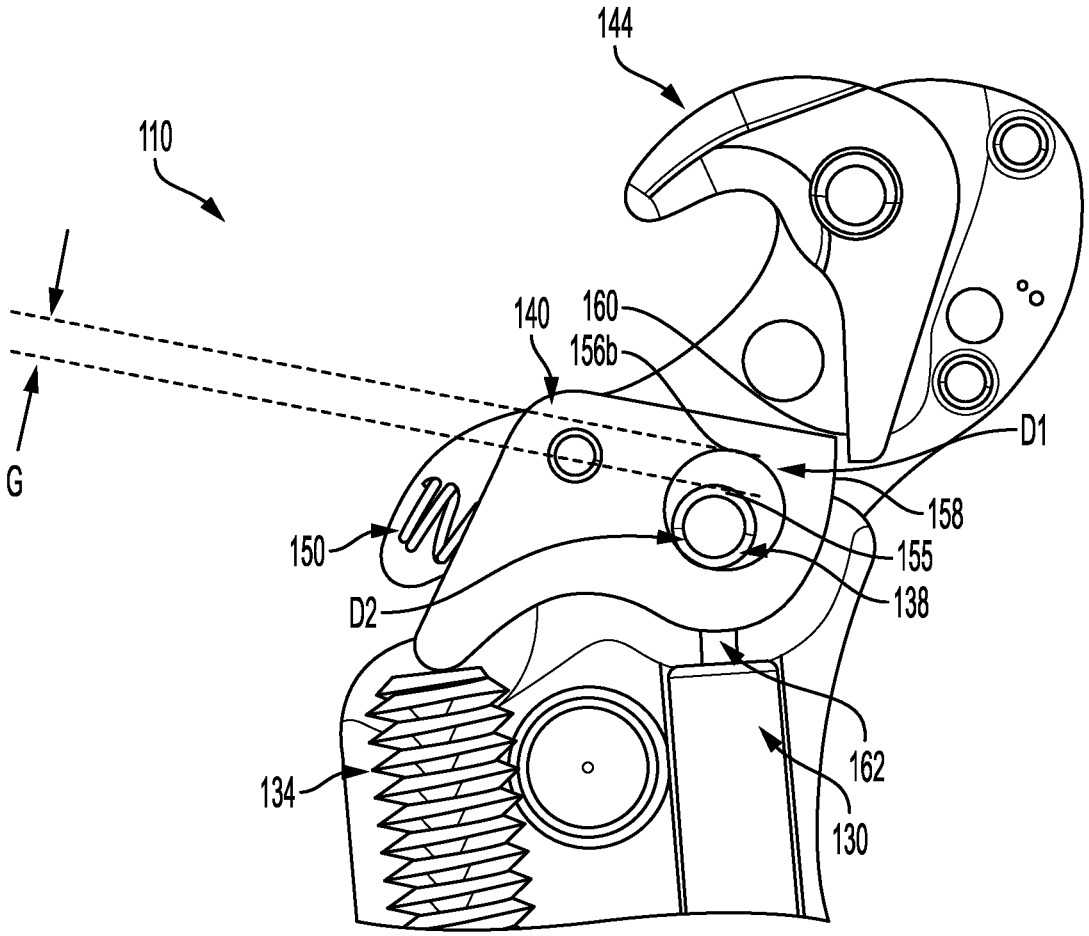
FIG. 20 is a close-up, enlarged view of the embodiment of FIG. 4, showing a portion of the body housing and the carriage housing removed and further showing the hook engager that is out of contact with the cord hook.

In the embodiment shown in FIGS. 10-11, the motion opening 156 has a dimension or diameter D1 that is substantially larger than the dimension or diameter D2 of the body element 138. The difference in the two diameters determines the extent to which the hook engager 140 can pivot relative to the body 112 during the firing operation. Accordingly, the movement of the carriage 136 does not entirely control the movement of the hook engager 140. As shown in FIG. 20, the difference between D1 and D2 defines or results in a gap G located between the upper surface 156*b* of the motion portion 143 and the upper portion 155 of the body element 138. Depending upon the embodiment, the magnitude of the gap G can be equal to 90% of D1, 80% of D1, 70% of D1, 60% of D1, 50% of D1, 40% of D1, 30% of D1 20% of D1 or any other suitable percentage of D1 or multiple of D2.

In operation, the user rotates the release point setter 134 to drive the adjustment engagement surface 164 and pivot the hook engager 140 to a desired angular position relative to the body 112. The hook engager 140 is pivotal between a plurality of angular positions, each of which is associated with a different release point or release position for the cord hook 144. The angular position determines the amount of distance the hook engagement surface 160 must travel and slide along the interference surface 158 before the cord hook 144 is freed and disengaged from the hook engager 140.

Furthermore, the user can operate the thumb grasp 124 to put the archery release device 100 in a safety mode to avoid unintentional firing. In response to the user's pulling or actuation of the thumb grasp 124, the spring activated safety driver 130 applies a force to the safety engagement surface 162 of the hook engager 140. This force moves the hook engager 140 counterclockwise so that the lower surface 156*a* of the motion opening 156 contacts the body element 138, establishing a maximum level of overlap and engagement between the interference surface 158 and the hook engagement surface 160. Accordingly, this maximum level of engagement provides security against an unintentional release of the draw cord 111. While in the safety mode, the safety driver 130 is locked in position and may inhibit rotation of the hook engager 140 by the release point setter 134. Operation of the thumb grasp 124 to release the safety mode acts to unlock the safety driver 130 such that the release point setter can be driven to rotate the hook engager 140 in a clockwise direction to decrease the overlap and engagement between the interference surface 158 and the hook engagement surface 160. The hook engager can be rotated to a point where the body element 138 contacts an upper surface 156*b* of the motion opening 156. Contact with the upper surface 156*b* establishes a minimum level of overlap and engagement between the interference surface 158 and the hook engagement surface 160.

Figure 16:
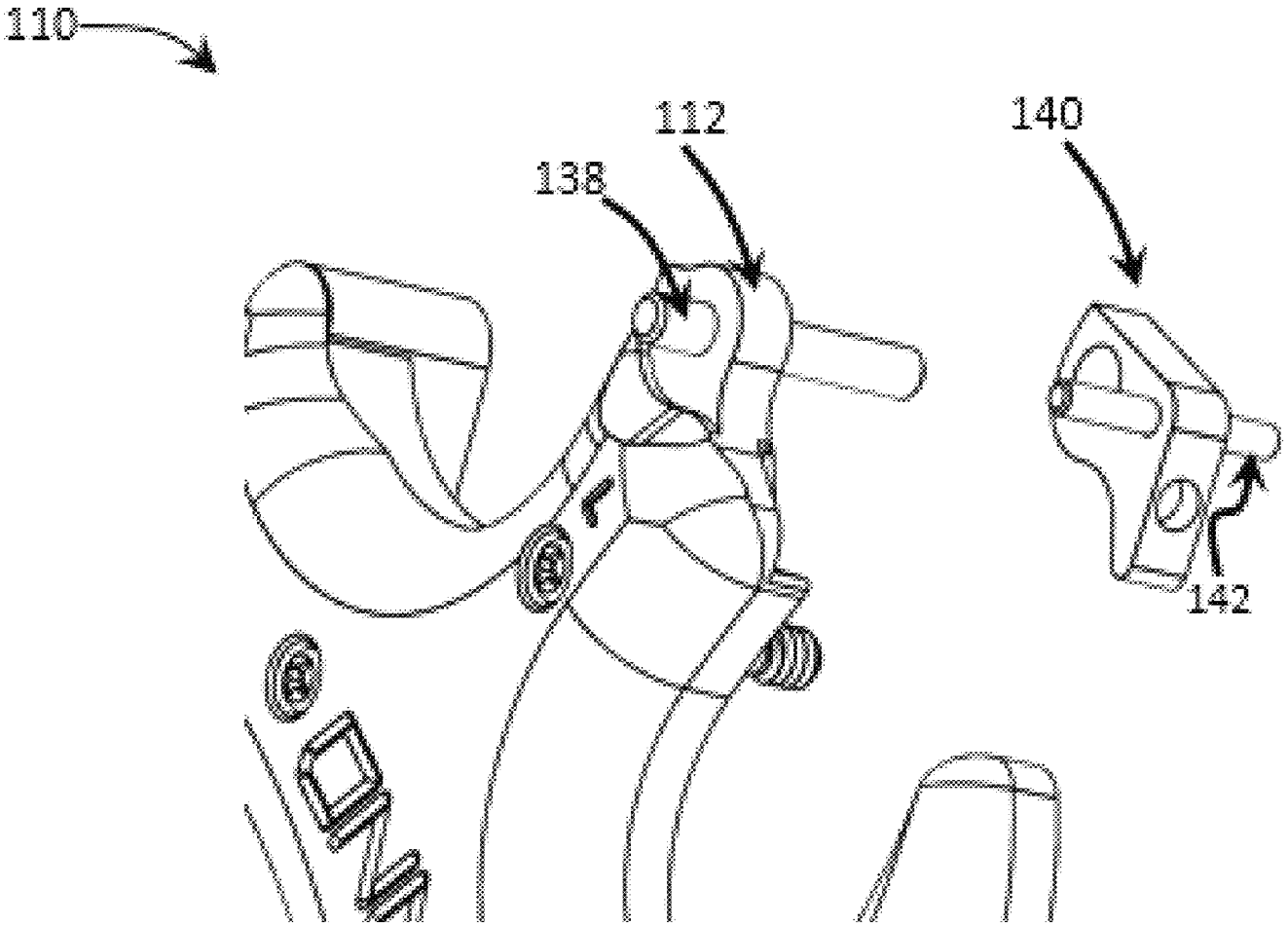
FIG. 16 is a close-up, enlarged view of the embodiment of FIG. 4, having the hook engager separated from the body of the archery release device.
Figure 16A:
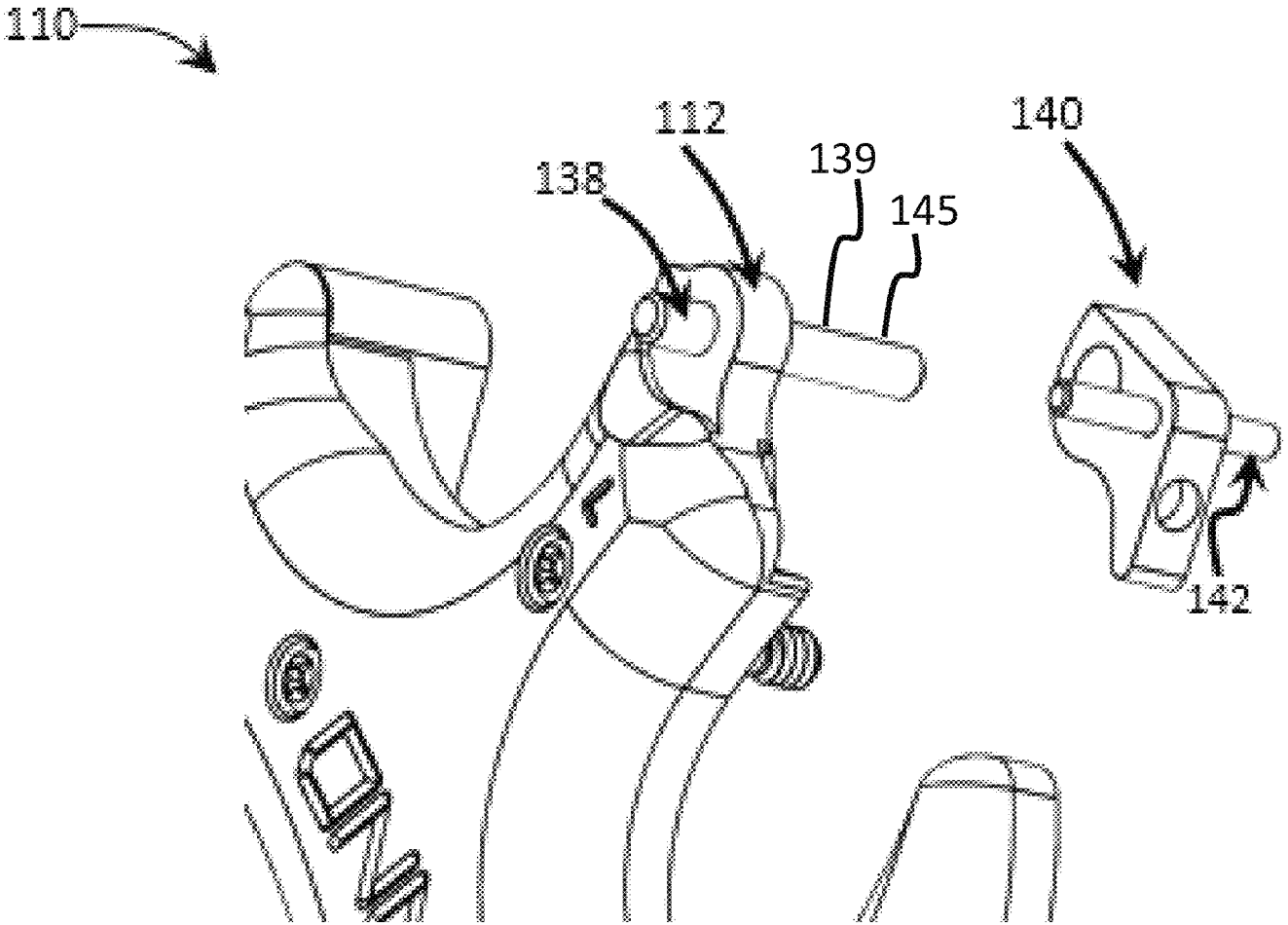
FIG. 16A is an isometric view of the embodiment of FIG. 4 in which the body element that simultaneously serves as a body pivot member and a stopper.

In the embodiment described above, the body element 138 has multiple purposes. The body element 138 is structured and functional as an axle or body pivot member 139, shown in FIG. 16A, that pivotally couples the carriage 136 to the body 112. Also, the body element 138 is structured and functional in relation to the hook engager 140 as a motion limiter, a post, a motion limiting member, a stop member or a stopper 145, shown in FIG. 16A.

Figure 16B:
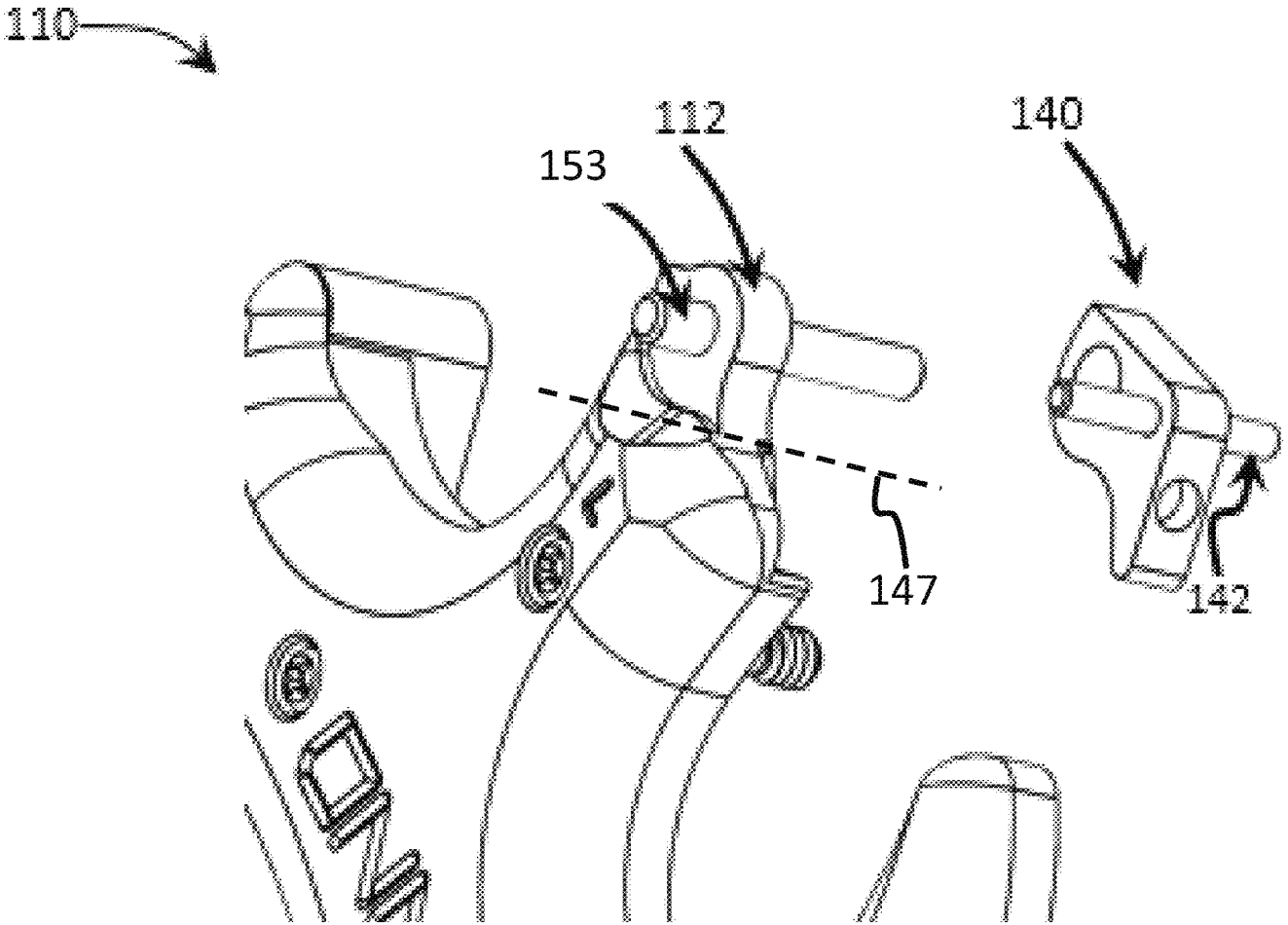
FIG. 16B is an isometric view of an alternative embodiment of FIG. 4 which includes a body pivot member and stopper as separate components.

In another embodiment, illustrated in FIG. 16B, the archery release device 110 includes two different components that serve as the body pivot member and the stopper. In such embodiment, a body pivot member 147 (diagrammatically illustrated via a dotted line) pivotally couples the carriage 136 to the body 112, but the body pivot member 147 does not extend through or interact with the hook engager 140. Also, in such embodiment, a stopper 153 (e.g., a post, extension or protrusion) is coupled or mounted to the body 112 and is configured to abut or protrude through the motion portion 143 of the hook engager 140.

As described above, in one example, the upper surface 156*b* (FIG. 12) of the motion opening 156 establishes a limit on the clockwise (and downward) movement of the hook engager 140. The lower surface 156*a* (FIG. 11) of the motion opening 156 establishes a limit on the counterclockwise movement (and upward) of the hook engager 140. As described above, the lower surface 156*a* limits the extent to which the safety driver 130 can cause an overlap between the interference surface 158 of the hook engager 140 and the hook engagement surface 160 of the cord hook 144.

Figure 17A:
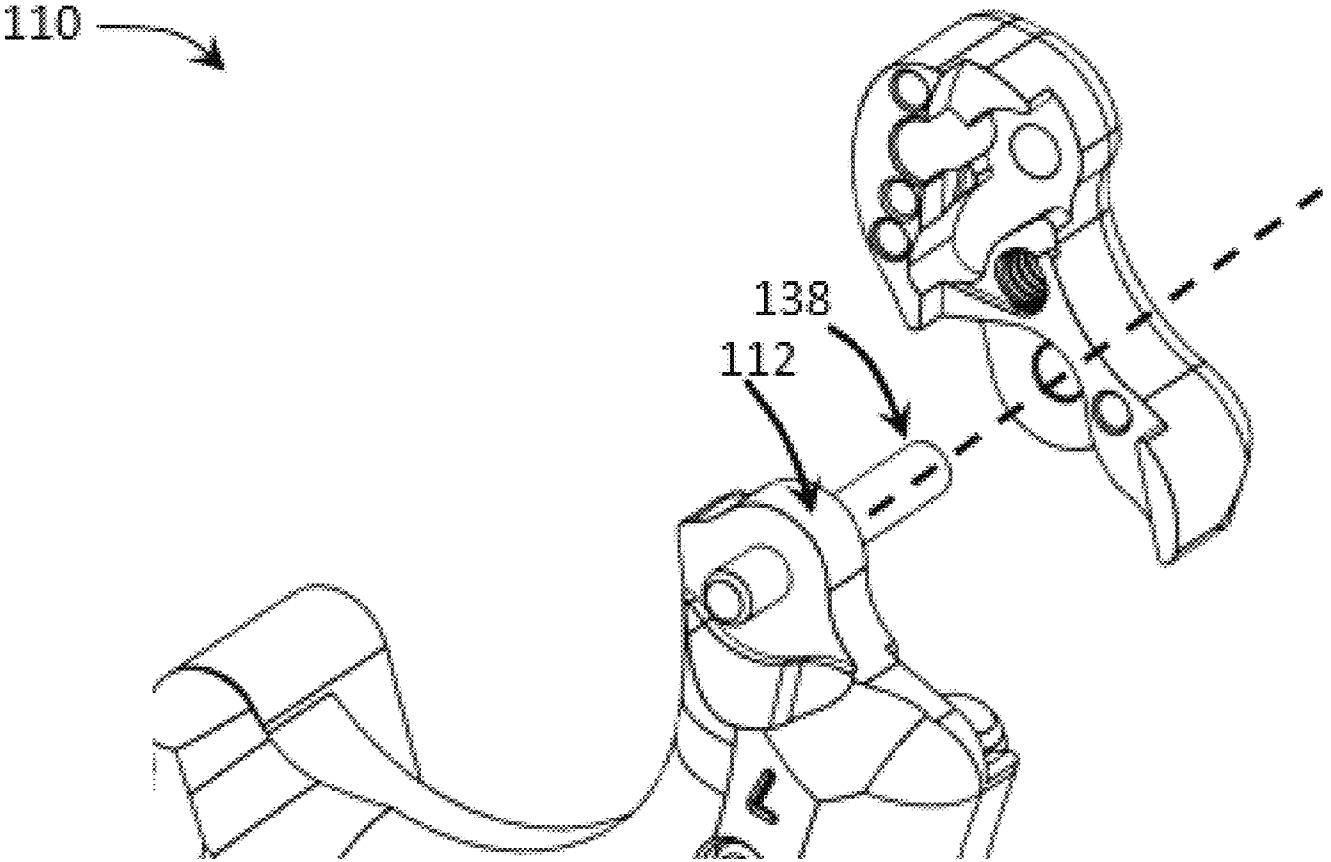
FIG. 17A is a close-up, enlarged view of the embodiment of FIG. 4, showing a body pivot member coupled to a portion of the body of the archery release device and also showing a portion of the carriage housing structured to engage the body pivot member or stopper.
Figures 17B, 17C:
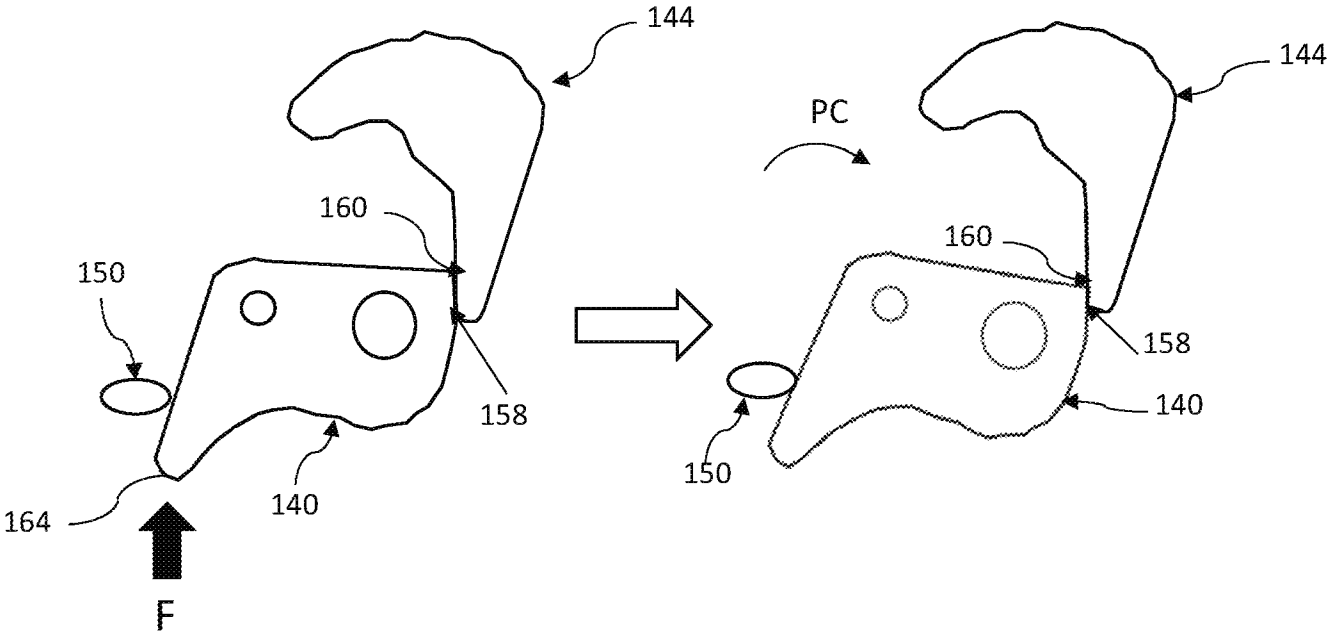
FIG. 17B is a schematic diagram of an embodiment of the hook engager, the cord hook and the biasing member in a first configuration or first positional arrangement.
FIG. 17C is a schematic diagram of the embodiment of FIG. 17B, showing the hook engager, the cord hook and the biasing member in a second configuration or second positional arrangement.
Figure 18:
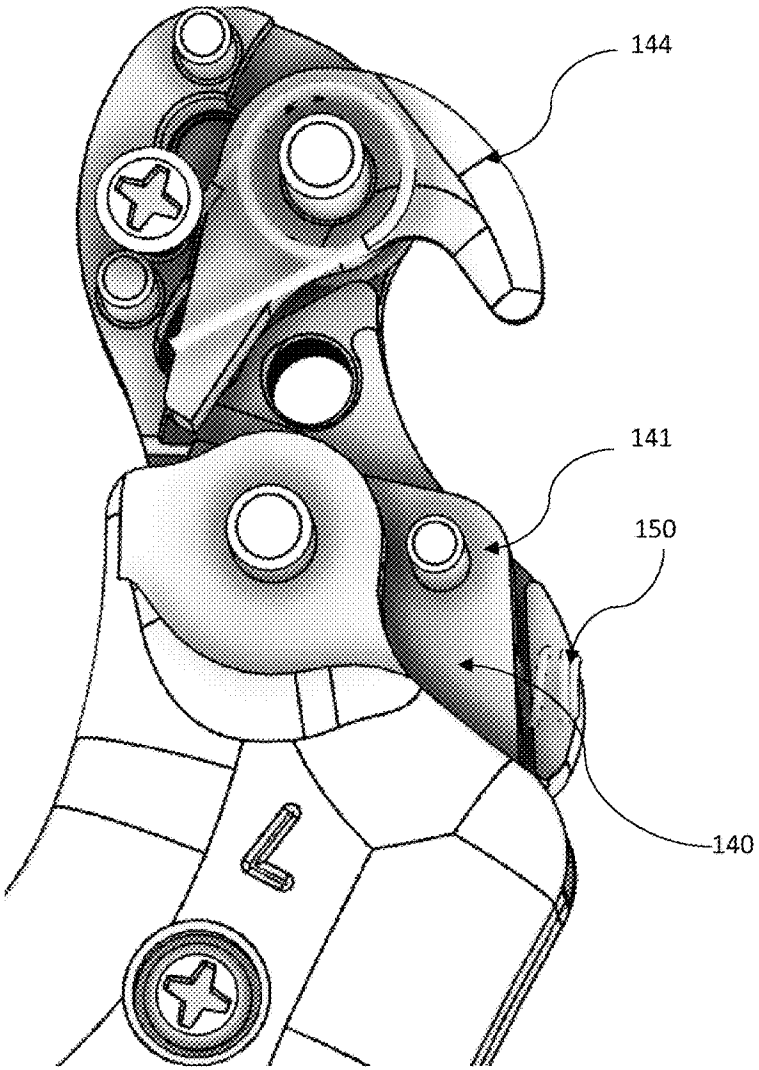
FIG. 18 is a close-up, enlarged view of the embodiment of FIG. 4, showing the carriage with a portion of the carriage housing removed.

Referring specifically to FIGS. 17B and 17C, FIG. 17B schematically illustrates an example of the state of maximum level of overlap and engagement between the interference surface 158 and the hook engagement surface 160. When a force F is applied at the adjustment engagement surface 164, the hook engager 140 pivots in a clockwise direction PC resulting in the configuration shown in FIG. 17C. As shown, the level of overlap and engagement between the interference surface 158 and the hook engagement surface 160 is less than that shown in FIG. 17B indicating a decrease in delay between trigger actuation and release of the draw cord 111 (FIG. 4). The biasing member 150 acts to exert a biasing force on the hook engager 140 to maintain contact between the interference surface 158 and the hook engagement surface 160 until the draw cord 111 overcomes the frictional engagement between the interference surface 158 and hook engagement surface 160.

Figure 19:
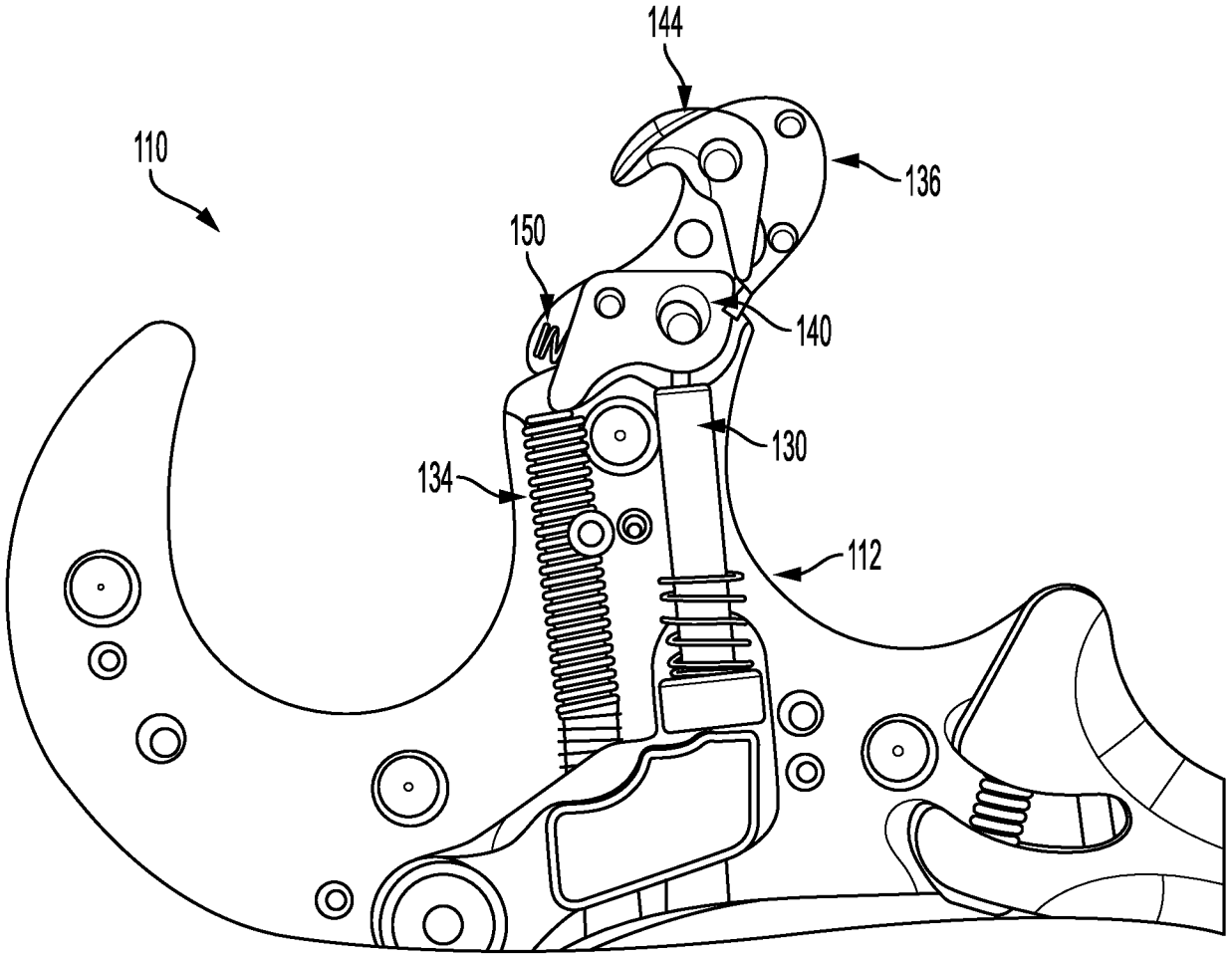
FIG. 19 is a side view of the embodiment of FIG. 4, showing a portion of the body housing and the carriage housing removed and further showing the hook engager in contact with the cord hook.
Figure 21:
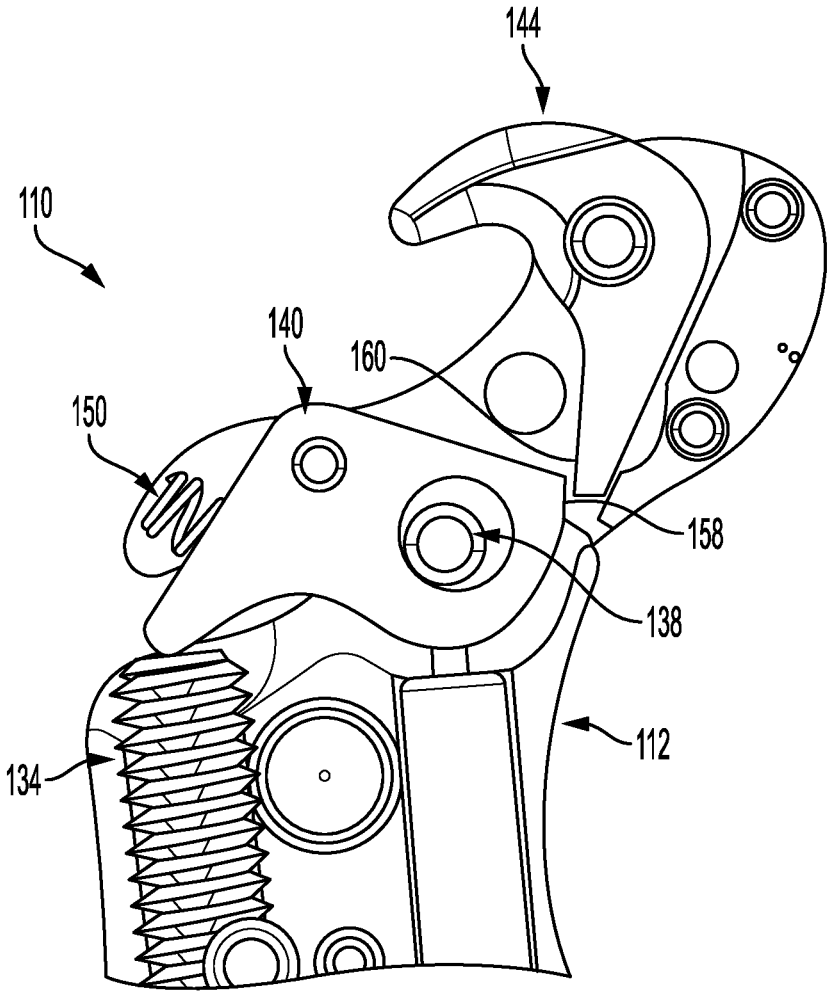
FIG. 21 is a close-up, enlarged view of the embodiment of FIG. 4, showing the hook engager being biased in a clockwise direction by the biasing member prior to the beginning of the firing operation.

As shown in FIGS. 18-23, when the archery release device 110 is in use, the carriage 136 is free to pivot relative to the body 112. During such pivoting, the interference surface 158 and the hook engagement surface 160 are initially overlapped and engaged with each other as shown in FIGS. 19-21. This immobilizes the cord hook 144 relative to the carriage 136. Comparing FIGS. 20 and 21, it can be seen that the release point setter 134 in FIG. 21 has been driven towards the hook engager 140 resulting in a clockwise pivoting of the hook engager 140, which reduces the overlap of the hook engager surface 160 for a shorter engagement time. Accordingly, the release delay experienced by the user using the configuration shown in FIG. 21 will be less than that of FIG. 20.

Figure 22:
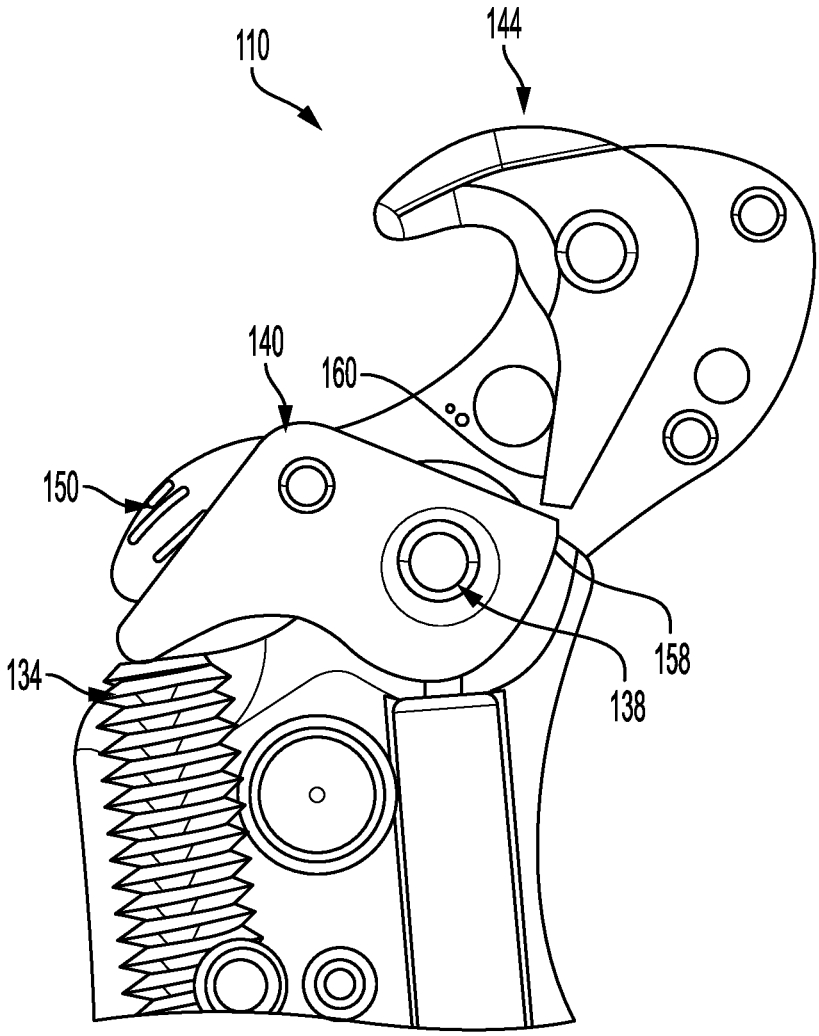
FIG. 22 is a close-up, enlarged view of the embodiment of FIG. 4, showing the hook engager being disengaged from the cord hook after the beginning of the firing operation.
Figure 23:
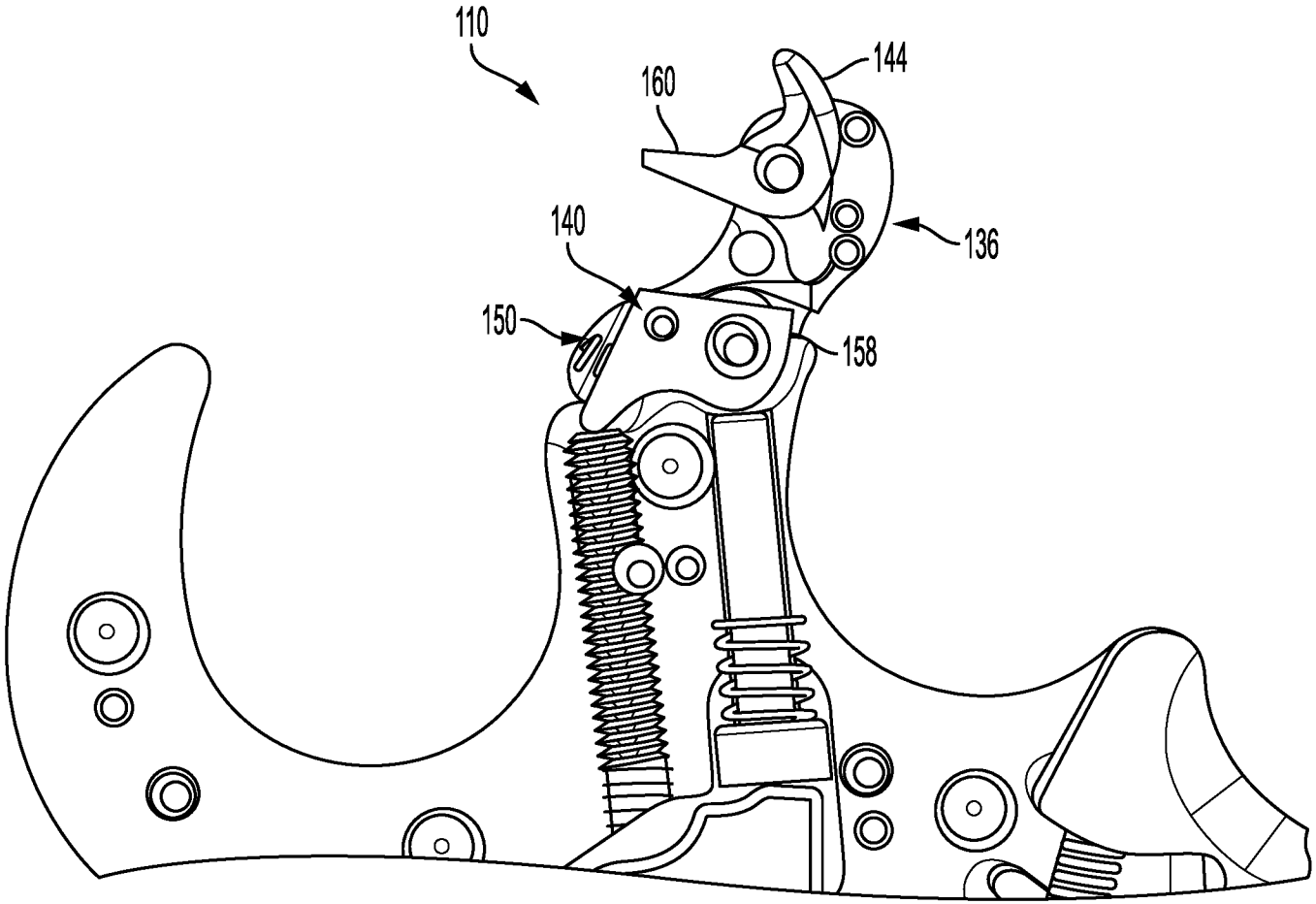
FIG. 23 is another view of the embodiment of FIG. 4 showing, the cord hook pivoting freely relative to the carriage after being disengaged from the hook engager.

The firing operation, which occurs after the safety is off, begins when the user jerks the archery release device 110 and ends when the cord hook 144 releases the draw cord 111. Generally, when the user applies a great enough force (e.g., rearward jerk action) to the body 112, the hook engager surface 160 overcomes the frictional engagement with the interference surface 158 and the force exerted by the biasing member 150, which causes the cord hook 144 to disengage from the hook engager 140 as shown in FIG. 22. Once the cord hook 144 is disengaged from the hook engager 140, the cord hook 144 is able to freely pivot relative to the carriage 136, which results in a release of the draw cord 111 (FIG. 4), as shown in FIG. 23.

During the firing operation, the hook engager 140 has freedom of movement relative to the carriage 136 unlike the prior art release aid. As described above, the pivot portion 141 of the hook engager 140 receives the hook engagement pivot member 142. This enables the hook engager 140 to pivot relative to the carriage 136. In addition, as described above, the freedom portion or motion portion 143 of the hook engager 140 defines the motion opening 156. The motion opening 156 at least partially receives the body element 138. The pivot motion opening 156 has a substantially larger dimension or diameter D1 (see FIG. 10) than the dimension or diameter D2 (see FIG. 11) of the body element 138 (e.g., 1.25, 1.5, 2, 3, 4 or 5 times greater). This larger diameter D1 (see FIG. 10) enables the hook engager 140 to pivot relative to the carriage 136 during the firing operation. The hook engager biasing member 150 applies a force to the bias interface portion 148 of the hook engager 140, which acts to bias the hook engager 140 into contact with the hook engagement surface 160 of the cord hook 144. When the safety mode is engaged, the safety driver 130 inhibits the force applied by the biasing member from being overcome, which inhibits the hook engager 140 from being disengaged with the cord hook 144 and thereby inhibiting release of the draw cord 111.

When the safety mode is not engaged (i.e., deactivated), the hook engager 140 remains engaged with the hook engagement surface 160 of the cord hook 144 until the firing operation begins. As previously mentioned. the firing operation begins when the user jerks the archery release device 110, which results in the hook engager 140 overcoming the force exerted by the hook engager biasing member 150. In the example shown in FIG. 20, the cord hook 144 rotates clockwise, which urges the hook engager 140 to counteract the spring force and pivot in a clockwise motion relative to the carriage 136. The gap G enables this pivoting action, an advantageous freedom of movement that occurs during the firing operation. A comparison of FIGS. 19-21 with FIGS. 22 and 23 shows that the clockwise pivoting of the hook engager 140 results in the interference surface 158 sliding along the hook engagement surface 160 until disengagement of the two surfaces 158, 160 occurs. Upon this disengagement, the cord hook 144 rotates in the clockwise direction to release the draw cord 111, which results in firing of the archery arrow or projectile.

Unlike the prior art release aid, the hook engager 140 is configured to readily give way to the cord hook 144 during the firing operation. Accordingly, it is easier for the hook cord 144 to disengage from the hook engager 140, which results in greater responsiveness to the user's jerk action and greater firing sensitivity. This configuration of the hook engager 140 also results in lower frictional feedback, lower vibrational feedback or lower force feedback to the archer, all of which can be disturbing to the firing experience.

The parts, components, and structural elements of the archery release device 110 (and each of its parts) can be combined into an integral or unitary, one-piece object through welding, soldering, plastic molding other methods, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery hook engager comprising:

a bias interface portion configured to be engaged with a biasing member of an archery release device that comprises a body, a carriage, a pivot member coupled to the carriage, and a hook that is pivotally coupled to the carriage;

a pivot portion that defines a pivot opening configured to receive the pivot member;

a motion portion that defines a motion opening configured to receive a stopper that is coupled to the body, wherein the stopper comprises a diameter, wherein the motion opening is greater in dimension than the diameter so as to define a gap between the motion portion and the stopper; and a hook interface portion configured to be engaged with a hook engagement portion of the hook, wherein, when the hook is engaged with a bowstring and the archery release device is jerked away from the bowstring, the motion portion is configured to move relative to the stopper to facilitate disengaging the hook interface portion from the hook engagement portion.

2. The archery hook engager of claim 1, further comprising an adjustment engagement surface configured to contact a release point setter.

3. The archery hook engager of claim 2, wherein:

the pivot member comprises a first pivot member;

the archery release device comprises a second pivot member that pivotally couples the carriage to the body; and wherein the second pivot member comprises the stopper.

4. The archery hook engager of claim 1, further comprising a safety engagement surface configured to engage with a safety driver.

5. The archery hook engager of claim 4, wherein the hook engager is configured to comprise a locked state, wherein the engagement between the safety engagement surface and the safety driver is configured to inhibit pivoting about the pivot member.

6. The archery hook engager of claim 1, wherein the motion opening is defined by:

an upper surface configured to limit a first directional pivoting about the pivot member; and a lower surface configured to limit a second directional pivoting about the pivot member.

7. An archery hook engager comprising:

a first portion defining a first opening configured to receive a pivot member of an archery release device that comprises a body, a carriage, and a hook pivotally coupled to the carriage, wherein the pivot member is coupled to the carriage;

a second portion configured to define a second opening that comprises an opening dimension, wherein the second opening is configured to receive a stopper that is coupled to the body, wherein the stopper comprises a stopper dimension, wherein a difference between the opening dimension and the stopper dimension results in a gap between the second portion and the stopper; and a hook interface portion configured to be engaged with a hook engagement portion of the hook.

8. The archery hook engager of claim 7, wherein, when the hook is engaged with a bowstring and the archery release device is jerked away from the bowstring, the second portion is configured to move relative to the stopper to facilitate disengaging the hook interface portion from the hook engagement portion.

9. The archery hook engager of claim 7, wherein:

the first portion comprises a pivot portion;

the second portion comprises a motion portion;

the pivot member comprises a first pivot member;

the archery release device comprises a second pivot member that pivotally couples the carriage to the body; and the second pivot member comprises the stopper.

10. The archery hook engager of claim 7, comprising a bias interface portion configured to be engaged with a biasing member of the archery release device.

11. The archery hook engager of claim 7, further comprising a safety engagement surface configured to engage with a safety driver.

12. The archery hook engager of claim 11, wherein the hook engager is configured to comprise a locked state, wherein the engagement between the safety engagement surface and the safety driver is configured to inhibit pivoting about the pivot member.

13. The archery hook engager of claim 7, wherein the second opening is defined by:

an upper surface configured to limit a first directional pivoting about the pivot member; and a lower surface configured to limit a second directional pivoting about the pivot member.

14. The archery hook engager of claim 7, further comprising an adjustment engagement surface configured to contact a release point setter.

15. An archery release device comprising:

the archery hook engager of claim 7; and the body, the carriage, and the hook, wherein the body comprises a plurality of finger interface surfaces.

16. A method of manufacturing an archery hook engager, the method comprising:

structuring a first portion so as to define a first opening configured to receive a pivot member of an archery release device that comprises a body, a carriage, and a hook pivotally coupled to the carriage, wherein the pivot member is coupled to the carriage;

structuring a second portion so as to define a second opening that comprises an opening dimension, wherein the second opening is configured to receive a stopper that is coupled to the body, wherein the stopper comprises a stopper dimension, wherein a difference between the opening dimension and the stopper dimension results in a gap between the second portion and the stopper; and structuring a hook interface portion to be engaged with a hook engagement portion of the hook.

17. The method of claim 16, comprising structuring the archery hook engager so that, when the hook is engaged with a bowstring and the archery release device is jerked away from the bowstring, the second portion is configured to move relative to the stopper to facilitate disengaging the hook interface portion from the hook engagement portion.

18. The method of claim 16, wherein:

the first portion comprises a pivot portion;

the second portion comprises a motion portion;

the pivot member comprises a first pivot member;

the archery release device comprises a second pivot member that pivotally couples the carriage to the body; and the second pivot member comprises the stopper.

19. The method of claim 16, comprising structuring a bias interface portion configured to be engaged with a biasing member of the archery release device.

20. The method of claim 16, comprising structuring an adjustment engagement surface configured to contact a release point setter.

21. The method of claim 16, comprising structuring the second portion so that the second opening is defined by:

an upper surface configured to limit a first directional pivoting about the pivot member; and a lower surface configured to limit a second directional pivoting about the pivot member.

* * * * *